US007586465B2

(12) United States Patent
Tessier et al.

(10) Patent No.: US 7,586,465 B2
(45) Date of Patent: Sep. 8, 2009

(54) COPLANAR DISCHARGE FACEPLATES FOR PLASMA DISPLAY PANEL PROVIDING ADAPTED SURFACE POTENTIAL DISTRIBUTION

(75) Inventors: Laurent Tessier, Fontaine (FR); Ana Lacoste, Saint Martin le Vinoux (FR)

(73) Assignee: Thomson Licensing, Boulogne Billancourt (FR)

( * ) Notice: Subject to any disclaimer, the term of this patent is extended or adjusted under 35 U.S.C. 154(b) by 694 days.

(21) Appl. No.: 10/518,567

(22) PCT Filed: Jun. 19, 2003

(86) PCT No.: PCT/EP03/50243

§ 371 (c)(1),
(2), (4) Date: Jul. 25, 2005

(87) PCT Pub. No.: WO04/001786

PCT Pub. Date: Dec. 31, 2003

(65) Prior Publication Data

US 2006/0043891 A1 Mar. 2, 2006

(30) Foreign Application Priority Data

Jun. 24, 2002 (FR) ..... 02 08094

(51) Int. Cl.
*G09G 3/20* (2006.01)

(52) U.S. Cl. ..... 345/60

(58) Field of Classification Search ..... 345/60; 313/484, 491
See application file for complete search history.

(56) References Cited

U.S. PATENT DOCUMENTS

| | | | | |
|---|---|---|---|---|
| 6,184,848 | B1 * | 2/2001 | Weber | 345/60 |
| 6,219,013 | B1 * | 4/2001 | Amano | 345/60 |
| 6,445,120 | B1 | 9/2002 | Kim et al. | |
| 2002/0030645 | A1 * | 3/2002 | Lee et al. | 345/68 |

FOREIGN PATENT DOCUMENTS

| | | |
|---|---|---|
| JP | 2000133150 | 5/2000 |
| JP | 2001-135238 | 5/2001 |

OTHER PUBLICATIONS

Search Report Dated Nov. 20, 2003.

* cited by examiner

*Primary Examiner*—Richard Hjerpe
*Assistant Examiner*—Shaheda A Abdin
(74) *Attorney, Agent, or Firm*—Robert D. Shedd; Harvey D. Fried; Patricia Verlangieri

(57) ABSTRACT

The invention concerns a faceplate comprising, for each discharge zone, at least two electrode elements having an axis of symmetry Ox and which are adapted such that the surface potential V(x) measured at the dielectric layer surface covering said elements increases, away from the edge of the discharge elements, continuously or discontinuously, without decreasing portion, when a constant potential difference is applied between the two electrodes serving said discharge zone, thereby substantially enhancing the panel luminous efficacy.

41 Claims, 9 Drawing Sheets

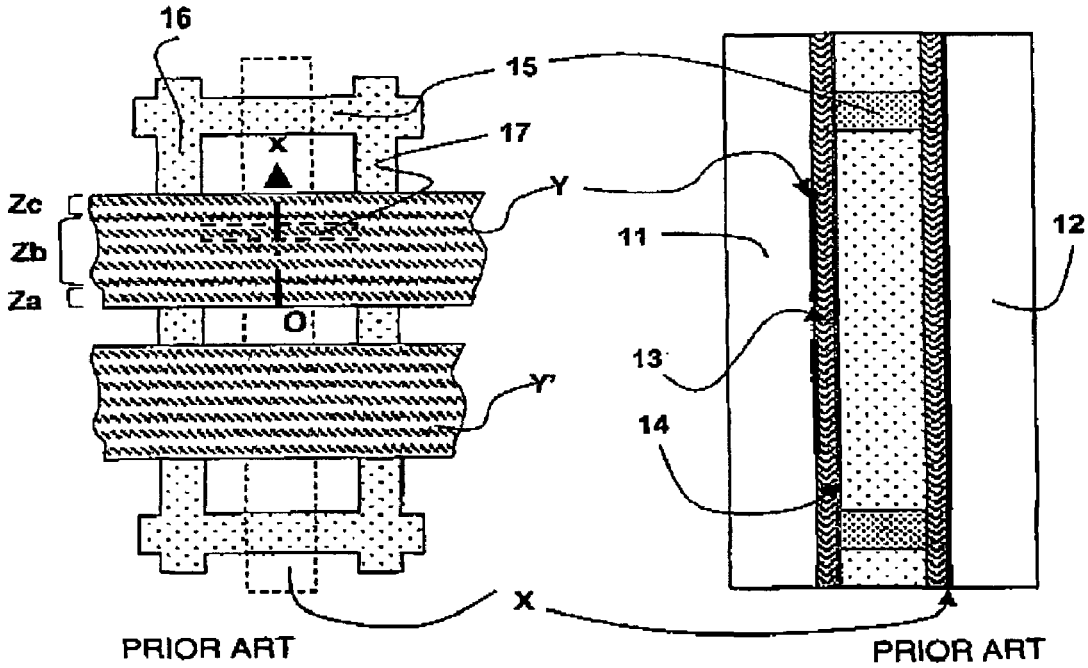
PRIOR ART
Fig.1-A
PRIOR ART
Fig.1-B
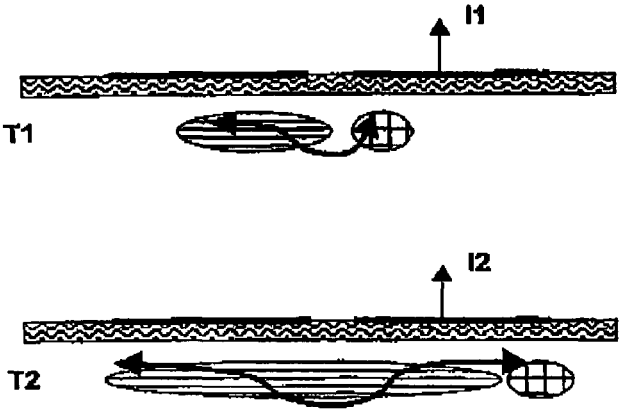
PRIOR ART
Fig.2-A
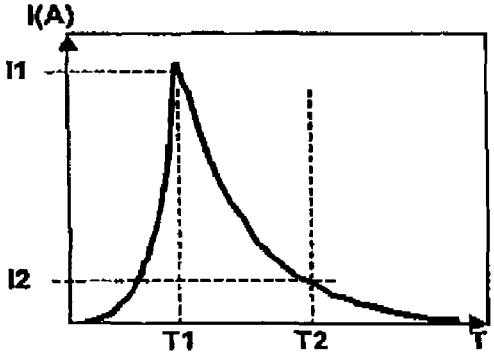
PRIOR ART
Fig.2-B

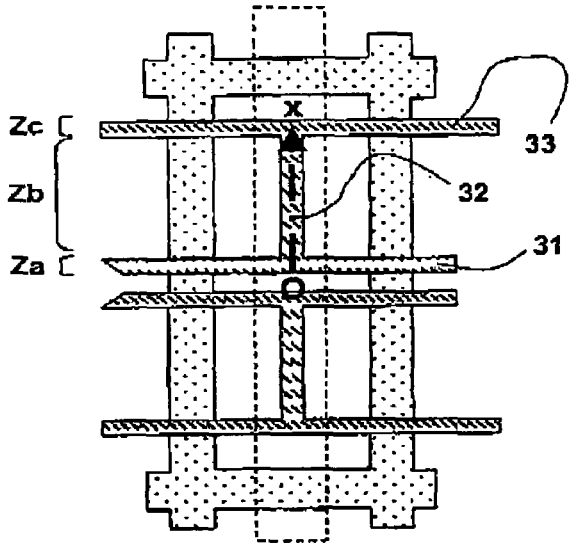
PRIOR ART
Fig.3-A
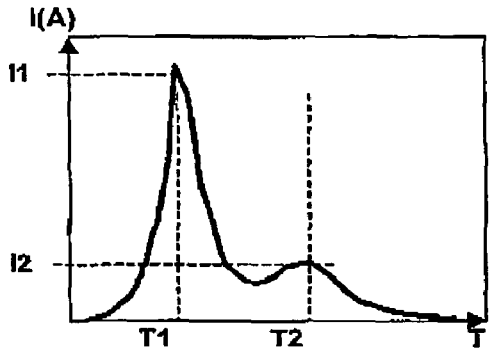
PRIOR ART
Fig.3-B
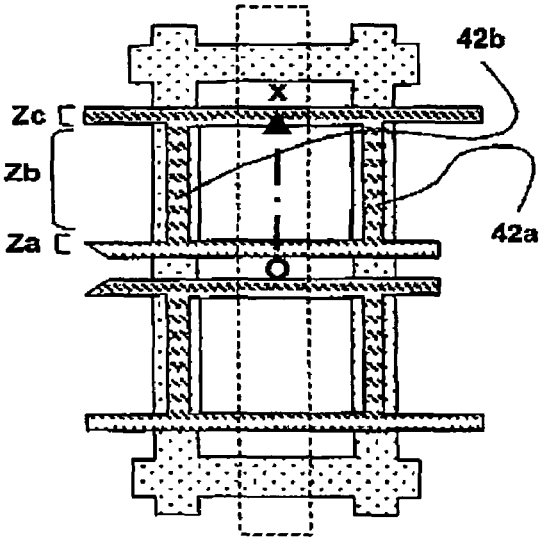
PRIOR ART
Fig.4-A
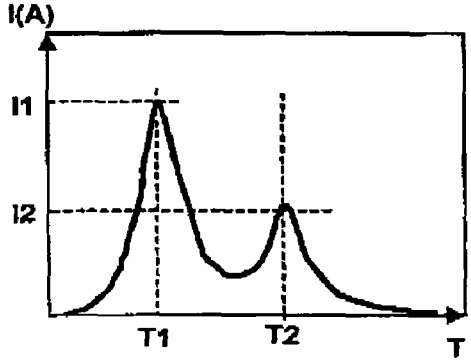
PRIOR ART
Fig.4-B

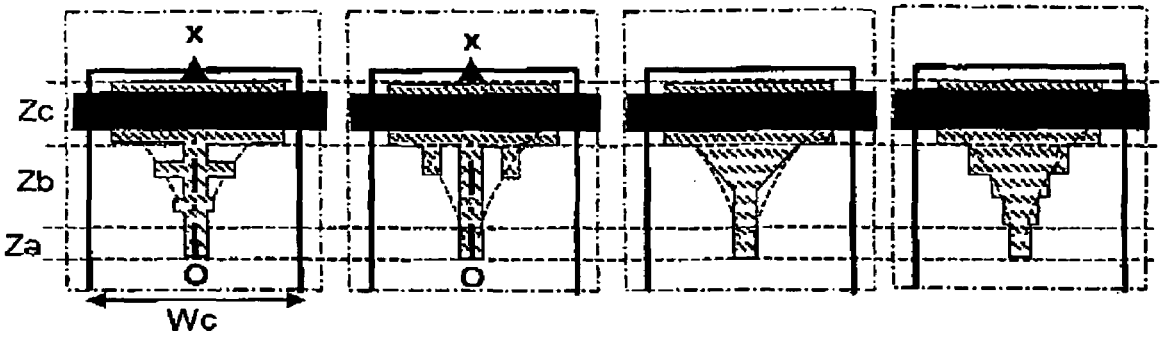
Fig.11A Fig.11B Fig.11C Fig.11D
Fig.12
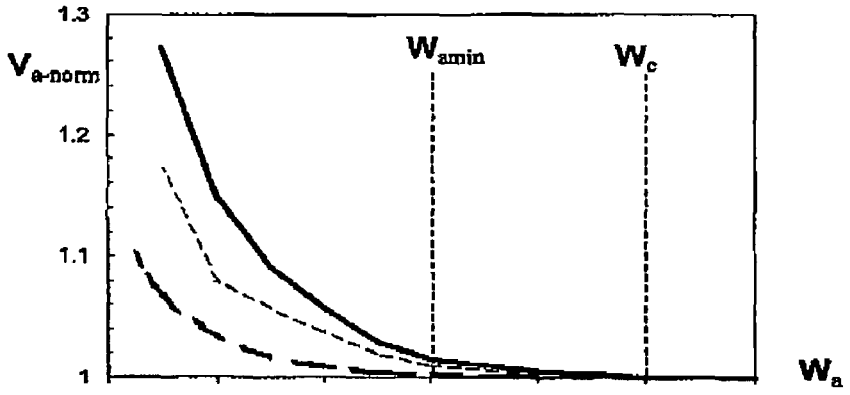
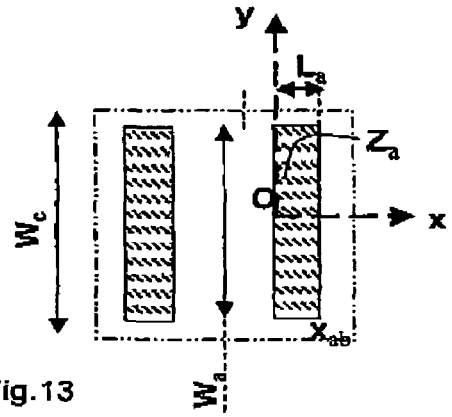
Fig.13
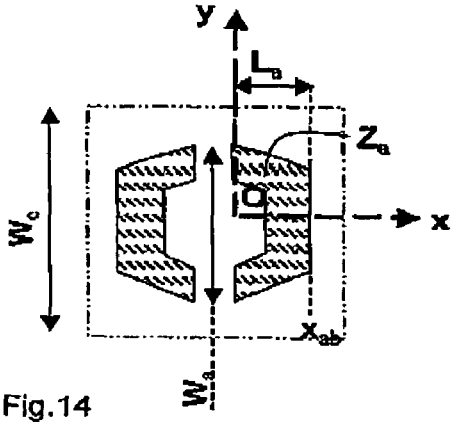
Fig.14

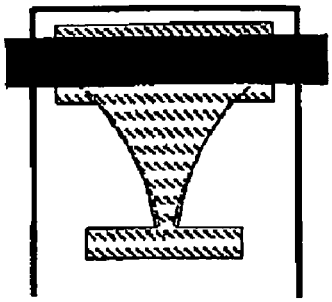
Fig.15A
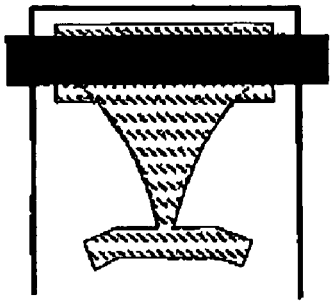
Fig.15B
Fig.16
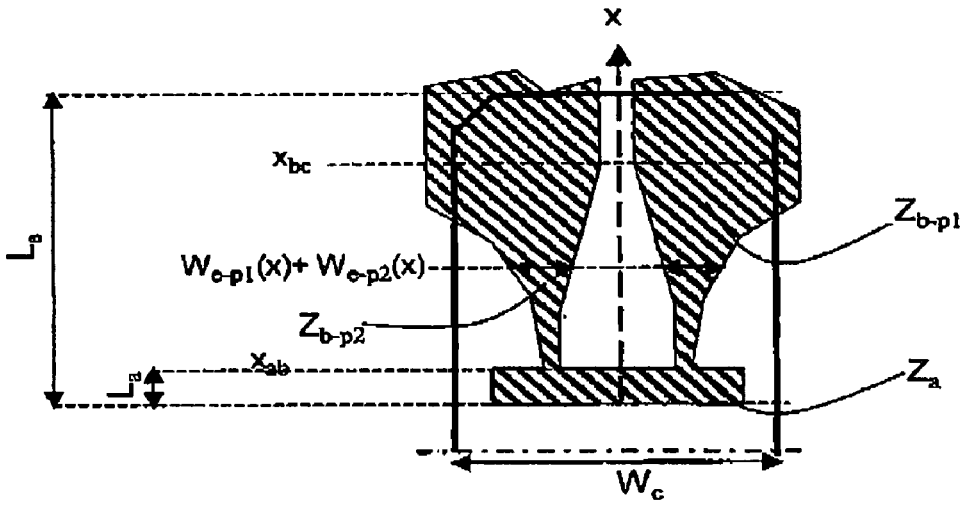
Fig.17
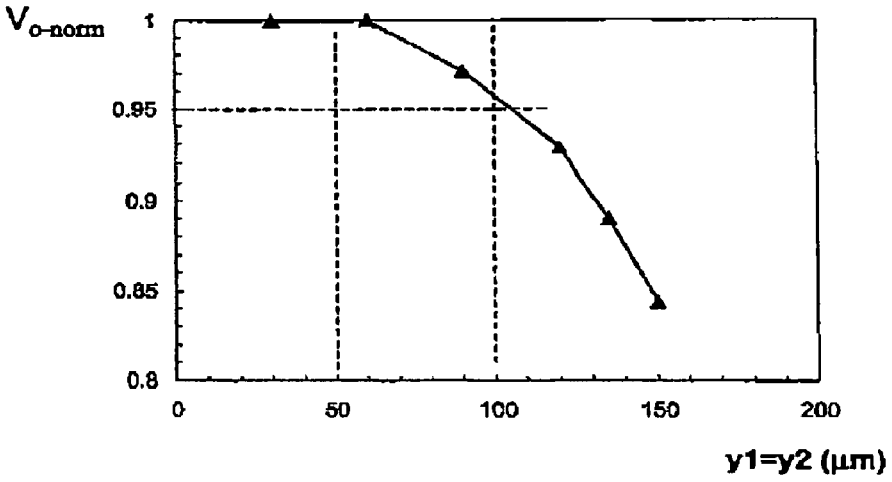

COPLANAR DISCHARGE FACEPLATES FOR PLASMA DISPLAY PANEL PROVIDING ADAPTED SURFACE POTENTIAL DISTRIBUTION

This application claims the benefit, under 35 U.S.C. § 365 of International Application PCT/EP03/50243, filed Jun. 19, 2003, which was published in accordance with PCT Article 21(2) on Dec. 31, 2003 in English and which claims the benefit of French patent application No. 0208094, filed Jun. 24, 2002.

1/ FIELD OF THE INVENTION

Referring to FIGS. 1A and 1B, the invention relates to the delimitation of discharge ignition, discharge expansion and discharge stabilization regions in the various cells or discharge regions of a plasma display panel.

2/ BACKGROUND OF THE INVENTION

A plasma display panel is generally provided with at least a first and a second array of coplanar electrodes, the general directions of which are parallel, where each electrode Y of the first array is adjacent to an electrode Y' of the second array, is paired with it and is intended to supply a set of discharge regions, and comprises, for each discharge region supplied:

- a conducting region $Z_a$ called a discharge ignition region, which comprises an ignition edge facing the said electrode of the second array;
- a conducting region $Z_b$ called a discharge expansion region, located to the rear of the conducting ignition region on the opposite side from the said ignition edge; and
- a conducting region $Z_c$ called a discharge stabilization or end-of-discharge region lying to the rear of the conducting expansion region, which comprises an end-of-discharge edge that delimits the said element on the opposite side from the said ignition edge.

The definition of these three regions will be supplemented later on in relation to the displacement of the cathode sheath.

These electrode plates are used for the manufacture of conventional plasma display panels of the type comprising a coplanar-discharge electrode plate 11, of the type mentioned above, and another electrode plate 12 provided with an array of address electrodes, leaving between them a two-dimensional set collecting the said discharge regions that are filled with a discharge gas.

Each discharge region is positioned at the intersection of an address electrode X and a pair of electrodes Y, Y' of the coplanar-discharge electrode plate; each set of discharge regions supplied by any one pair of electrodes corresponds in general to a horizontal row of discharge regions or subpixels of the display panel; and each set of discharge regions supplied by any one address electrode corresponds in general to a vertical column of discharge regions or subpixels.

The arrays of electrodes of the coplanar-discharge electrode plate are coated with a dielectric layer 13 in order to provide a memory effect, the said layer itself being coated with a protective and secondary-electron-emitting layer 14, generally based on magnesia.

The adjacent discharge regions, at least those that emit different colours, are generally bounded by horizontal barrier ribs 15 and/or vertical barrier ribs 16, these ribs generally also serving as spacers between the electrode plates.

The cell shown in FIGS. 1A and 1B is of rectangular shape—other cell geometries are disclosed by the prior art— and the largest dimension of this cell extends parallel to the address electrodes X. Let Ox be the longitudinal axis of symmetry of this cell; at each discharge region supplied by a pair of electrodes, which forms a discharge cell, the electrode portions or elements Y, Y' bounded by the barrier ribs 15, 16 have here a constant width measured along the direction perpendicular to the Ox axis.

The walls of the luminous discharge regions are in general partly coated with phosphors that are sensitive to the ultraviolet radiation of the luminous discharges. Adjacent discharge regions are provided with phosphors that emit different primary colours, so that the combination of the three adjacent regions forms a picture element or pixel.

During operation, to display an image, for example a video sequence:

- by means of the array of address electrodes and one of the arrays of coplanar electrodes, each row of the display panel is addressed in succession by depositing electrical charges on the region of dielectric layer of each discharge region of this row that has been preselected and the corresponding subpixel of which has to be activated in order to display the image; and then
- by applying series of sustain voltage pulses between the electrodes of the two arrays of the coplanar-discharge electrode plate, discharges are produced only in the pre-charged regions, thereby activating the corresponding subpixels and allowing the image to be displayed.

FIG. 15 of document EP 0 782 167 (Pioneer) and FIG. 3A below show a coplanar-discharge electrode plate of the type mentioned above in which, in each discharge region supplied via a pair of electrodes, each electrode of this pair comprises an element in the form of a T comprising a transverse bar 31 facing the other electrode and a central leg of constant width 32, each electrode element being electrically connected via a conducting bus 33 via the foot of its central leg.

Each transverse bar 31 of an electrode element forms a discharge ignition region $Z_a$, each central leg 32 forms a discharge expansion region $Z_b$ and each transverse bar 33 can form a discharge stabilization region $Z_c$. In operation, during the sustain phases, each discharge starts at one of the edges, called the ignition edge, of the transverse bar 31 and then extends along the corresponding leg 32 as far as the bus 33 to which it is connected.

A variant of the T shape is shown in FIG. 14 of the same document EP 0 782 167 (Pioneer). This is in the form of an upside-down U that has two side legs (instead of one central leg) that are perpendicular to the same transverse ignition bar as previously, which are each connected to one end of this bar. After ignition, the discharge subdivides and then extends along two parallel lateral expansion paths each corresponding to one leg of the upside-down U, the two paths joining up at the conducting bus of the electrode.

According to another variant described in document EP 0 802 556 (Matsushita), especially in FIG. 9 and reproduced in FIG. 4A below, each lateral leg of the U, 42*a*, 42*b*, is shared between two adjacent cells and the transverse bars of the elements of the same electrode form a continuous conductor, in such a way that each coplanar electrode takes the form of a ladder, a first rail of which serves as an ignition region $Z_a$, the rungs of which are positioned at the limit of the discharge region and serve as discharge expansion regions $Z_b$, and a second rail of which serves as a stabilization region $Z_c$.

Such a process for spreading the discharges along an expansion region forming an electrode portion is favourable to the efficiency of ultraviolet radiation production from the discharges and to a wider distribution over the surfaces of the excited phosphors.

3/ SUMMARY OF THE INVENTION

It is an object of the invention to define a novel type of coplanar-discharge plasma display panel cell that further improves and optimizes the luminous efficiency of the discharges and the lifetime of a plasma display panel.

For this purpose, one of the subjects of the invention is a coplanar-discharge electrode plate for defining discharge regions in a plasma display panel, which comprises:

at least a first and a second array of coplanar electrodes that are coated with a dielectric layer and the general directions of which are parallel, where each electrode of the first array is adjacent to an electrode of the second array, is paired with it and is intended to supply a set of discharge regions;

for each discharge region, at least two electrode elements that have a common longitudinal axis of symmetry Ox, each connected to an electrode of a pair, characterized in that, for each electrode element of each discharge region, the point O on the Ox axis being located on what is called an ignition edge of the said electrode element facing the other electrode element of the said discharge region and the Ox axis being directed towards what is called an end-of-discharge edge that delimits the said element on the opposite side from the said discharge edge and is positioned at $x=x_{cd}$ on the Ox axis, the shape of the said electrode element and the thickness and composition of the said dielectric layer are adapted so that there is an interval $[x_{ab},x_{bc}]$ of values of x such that $x_{bc}-x_{ab}>0.25x_{cd}$, $x_{ab}<0.33x_{cd}$ and $x_{bc}>0.5x_{cd}$ and such that the surface potential V(x) increases as a function of x in a continuous or discontinuous manner, without a decreasing part, from a value $V_{ab}$ to a higher value $V_{bc}$ within the said $[x_{ab},x_{bc}]$ interval when a constant potential difference is applied between the two electrodes supplying the said discharge region, having the appropriate sign so that the said electrode element acts as cathode.

When the electrode element acts as cathode, the surface of the dielectric layer that covers it becomes positively charged.

The surface potential V(x) therefore increases continuously or discontinuously in jumps, from $x=x_{ab}$ to $x=x_{bc}$. The derivative of this potential with respect to x, i.e. dV(x)/dx, is therefore positive or zero for any x such that $x_{ab}<x<x_{bc}$.

Preferably, for each discharge region, the two opposed electrode elements and the subjacent dielectric layer are identical and symmetrical with respect to the centre of the inter-electrode space.

When this electrode plate is integrated into a plasma display panel and series of constant-plateau sustain pulses are applied between the two arrays of electrodes, for each discharge region, each of the two electrode elements serves alternately as anode and as cathode.

Conventionally, each coplanar sustain discharge in this display panel therefore comprises, in succession, an ignition phase, an expansion phase and an end-of-discharge or stabilization phase during which the cathode sheath of the discharge does not move, moves, disappears or stabilizes, respectively.

Each electrode element of each discharge region in this display panel therefore conventionally comprises:

a conducting discharge ignition region $Z_a$ which comprises the said ignition edge and corresponds to that region of the dielectric layer on which the ions of a discharge are deposited during the said ignition phase when the said element acts as cathode;

a conducting discharge expansion region $Z_b$ that is located to the rear of the said ignition region $Z_a$, on the opposite side from the said ignition edge, and corresponds to that region of the dielectric layer swept by the displacement of the cathode sheath during the said expansion phase when the said element acts as cathode; and a conducting end-of-discharge or stabilization region $Z_c$ located to the rear of the said expansion region $Z_b$, which region $Z_c$ comprises the said end-of-discharge edge and corresponds to that region of the dielectric layer on which the ions of a discharge are deposited during the said end-of-discharge or stabilization phase when the said element acts as cathode.

According to the invention, the $[x_{ab},x_{bc}]$ interval defines, on the said electrode element, the said expansion region $Z_b$ that represents at least 25% of the total length $L_e=x_{cd}$ of the electrode element.

Thanks to the invention, at each sustain pulse, even before the ignition of a discharge, what is obtained, for each electrode element of each discharge region in this display panel, along the Ox axis, is a potential distribution that increases as a function of x at the surface of the dielectric layer covering the expansion region of this electrode element when it serves as cathode during the said pulse.

Such electrode elements and the subjacent dielectric layer allow the sustain discharges to spread rapidly over the ignition region as far as the end-of-discharge or stabilization region, with minimum energy dissipation in the ignition region and maximum energy dissipation in the high-efficiency end-of-discharge region, while still using conventional sustain pulse generators delivering, between the electrodes of the various pairs, conventional series of sustain voltage pulses, in which each pulse comprises a constant-voltage plateau, without any pronounced increase in the electrical potential applied.

To summarize, the subject of the invention is a coplanar-discharge electrode plate for a plasma display panel which comprises, for each discharge region, at least two electrode elements that have an axis of symmetry Ox and are designed so that the surface potential V(x) measured at the surface of the dielectric layer covering these elements increases, on moving away from the discharge edge of the elements, in a continuous or discontinuous manner, without a decreasing part, when a constant potential difference is applied between the two electrodes supplying the said discharge region.

A coplanar electrode plate according to the invention makes it possible to obtain plasma display panels of improved luminous efficiency and longer lifetime.

Preferably, $V_{norm}(x')-V_{norm}(x)>0.001$ whatever x and x' are, chosen between $x_{ab}$ and $x_{bc}$, such that $x'-x=10$ μm.

Preferably, defining the normalized surface potential $V_{norm}(x)$ as the ratio of the surface potential V(x) at a level x of the dielectric layer for the electrode element in question to the maximum potential $V_{0\text{-}max}$ that would be obtained along the Ox axis for an electrode element of infinite width, the normalized surface potential $V_{norm}(x)$ increasing from a value of $V_{n\text{-}ab}=V_{ab}/V_{0\text{-}max}$ at the start ($x=x_{ab}$) of the said interval to a value of $V_{n\text{-}bc}=V_{bc}/V_{0\text{-}max}$ at the end ($x=x_{bc}$) of the said interval, then:

$$V_{n\text{-}bc}>V_{n\text{-}ab},\ V_{n\text{-}ab}>0.9,\ \text{and}\ (V_{n\text{-}bc}-V_{n\text{-}ab})<0.1.$$

In a plasma display panel into which this coplanar electrode plate is integrated, by definition the normalized surface potential $V_{norm}(x)$ of the dielectric at the end of the expansion region and in the stabilization region will generally be close to 1, the bus of the electrode to which the electrode element in question is connected corresponding to a region of quasi-infinite width of the electrode element at this point. In the ignition region or at the start of the expansion region, it is important for the normalized surface voltage of the dielectric layer to be as close as possible to 1, in practice around 0.95. A substantial departure from this value 1, such as for example 0.8, would mean an increase in the actual ignition voltage, which is always detrimental as it requires more expensive electronic components. Thus, the lower limit of $V_{n-ab}$ and the upper limit of the potential difference $\Delta V_n = V_{n-bc} - V_{n-ab}$ are required so as to limit the punitive increase in potential difference to be applied between the electrode elements of any one cell in order to ignite the discharges when the coplanar electrode plate according to the invention is incorporated into a plasma display panel.

Preferably, under the same conditions of application of the potential difference between the said electrodes, the maximum potential in the surface region of the dielectric layer that covers the said element and is bounded by the said end-of-discharge edge where $x=x_{cd}$ and the position $x=x_{bc}$ is strictly greater than the maximum potential of the surface region of the dielectric layer that covers the said element and is bounded by the said ignition edge where x=0 and the position $x=x_{ab}$.

When this electrode plate is integrated into a plasma display panel and series of constant-plateau sustain pulses are applied between the two arrays of electrodes, it is then found that, for each discharge region, the maximum potential of the surface of the dielectric layer located in the ignition region $Z_a$, at each sustain pulse, even before ignition of a discharge, is strictly less than the maximum potential of the surface of the dielectric layer in the stabilization region $Z_c$.

Thanks to this feature, the stable operating point of the discharge cannot be the ignition region once the discharge has been initiated and, once initiated, the discharge necessarily spreads out into the expansion region along the surface of the dielectric layer towards the end-of-discharge edge.

The subject of the invention is also a plasma display panel provided with a coplanar electrode plate according to the invention.

The subject of the invention is also a coplanar-discharge electrode plate for defining discharge regions in a plasma display panel, which comprises:

at least a first and a second array of coplanar electrodes that are coated with a dielectric layer and the general directions of which are parallel, where each electrode of the first array is adjacent to an electrode of the second array, is paired with it and is intended to supply a set of discharge regions;

for each discharge region, at least two electrode elements that have a common longitudinal axis of symmetry Ox, each connected to an electrode of a pair, characterized in that, for each electrode element of each discharge region, the point O on the Ox axis being located on what is called an ignition edge of the said electrode element facing the other electrode element of the said discharge region and the Ox axis being directed towards what is called an end-of-discharge edge that delimits the said element on the opposite side from the said discharge edge and is positioned at $x=x_{cd}$ on the Ox axis, defining the specific longitudinal capacitance C(x) of the dielectric layer of the coplanar electrode plate as the capacitance of a straight elementary strip of this layer, bounded between the said electrode element and the surface of the dielectric layer, positioned at x on the Ox axis, having a length dx along this Ox axis and a width corresponding to that of the electrode element delimiting the said elementary strip, the shape of the said electrode element and the thickness and composition of the said dielectric layer are adapted so that there is an interval $[x_{ab}, x_{bc}]$ of values of x such that $x_{bc} - x_{ab} > 0.25x_{cd}$, $x_{ab} < 0.33x_{cd}$ and $x_{bc} > 0.5x_{cd}$ and such that this specific longitudinal capacitance C(x) of the dielectric layer increases continuously or discontinuously, without a decreasing part, from a value $C_{ab}$ at the start ($x=x_{ab}$) of the said interval to a value $C_{bc}$ at the end ($x=x_{bc}$) of the said interval.

What is thus obtained is a coplanar electrode plate having an increasing distribution of the surface potential of the dielectric layer.

The width $W_e(x)$ or $W_a(x)$ of the electrode element delimiting the said straight elementary strip may be discontinuous, for example when the said element is subdivided into two lateral conducting elements. In this case, the sum of the width of each lateral conducting element is taken.

Preferably, the capacitance of the dielectric layer portion that lies between the said element and the surface of this layer and is bounded by the said end-of-discharge edge where $x=x_{cd}$ and the position $x=x_{bc}$ is strictly greater than the capacitance of the dielectric layer portion that lies between the said element and the surface of this layer and is bounded by the said ignition edge where x=0 and the position $x=x_{ab}$.

When this electrode plate is integrated into a plasma display panel and series of constant-plateau sustain pulses are applied between the two arrays of electrodes, it is then found that, for each discharge region, the total capacitance of the dielectric layer corresponding to the said stabilization region $Z_c$ is greater than the total capacitance of the dielectric layer corresponding to the said ignition region $Z_a$.

Thanks to this feature, the stable operating point of the discharge cannot be the ignition region once the discharge has been initiated, and, once initiated, the discharge necessarily spreads out into the expansion region along the surface of the dielectric layer towards the end-of-discharge edge.

Preferably, the specific longitudinal capacitance of the dielectric layer in the region lying between $x=x_{bc}$ and $x=x_{cd}$ is greater than the specific longitudinal capacitance of the dielectric layer at any other position x such that $0<x<x_{bc}$.

When this electrode plate is integrated into a plasma display panel and series of constant-plateau sustain pulses are applied between the two arrays of electrodes, it is then found that, for each discharge region, the specific longitudinal capacitance of the dielectric layer in the stabilization region $Z_c$ is greater than the specific longitudinal capacitance of the dielectric layer at any other position x in the expansion region $Z_b$ or in the ignition region $Z_a$.

Advantageously, maximum energy dissipation of the discharges is then obtained in the end-of-discharge region $Z_c$ having a high luminous efficiency.

The subject of the invention is also a plasma display panel provided with a coplanar electrode plate with an increasing specific capacitance according to the invention.

The subject of the invention is also a plasma display panel comprising:

a coplanar electrode plate for defining discharge regions, which comprises at least a first and a second array of coplanar electrodes which are coated with a dielectric layer and the general directions of which are parallel, where each electrode of the first array is adjacent to an electrode of the second array, is paired with it and is intended to supply a set of discharge regions; and an address electrode plate optionally comprising an array of address electrodes that are coated with a dielectric layer and are oriented and positioned so that each crosses a pair of electrodes of the coplanar electrode plate in one of the said discharge regions, these electrode plates defining between them the said discharge regions and being separated by a distance $H_c$ expressed in microns, and, for each discharge region, at least two electrode elements that have a common longitudinal axis of symmetry Ox, each connected to an electrode of a pair, characterized in that, for each electrode element of each discharge region, the point O on the Ox axis being located on what is called an ignition edge of the said electrode element facing the other electrode element of the said discharge region and the Ox axis being directed towards what is called an end-of-discharge edge that delimits the said element on the opposite side from the said discharge edge and is positioned at $x=x_{cd}$ on the Ox axis, the shape of the said electrode element, letting E1($x$) be the mean thickness expressed in microns and P1($x$) be the mean relative permittivity of the dielectric layer above the said electrode element (4) at the longitudinal position x and letting E2($x$) be the mean thickness expressed in microns and P2($x$) be the mean relative permittivity of the dielectric layer above the said address electrode (X), or that of the address electrode plate (2) in the absence of the address electrode, the thickness and the permittivity both again being measured at the longitudinal position x located on an axis which lies on the surface of the address electrode plate and is parallel to the Ox axis and lying in a plane normal to the surface of the said coplanar electrode plate, the thickness and the composition of this dielectric layer are adapted so that there is an interval $[x_{ab},x_{bc}]$ of values of x such that $x_{bc}-x_{ab}>0.25x_{cd}$, $x_{ab}<0.33x_{cd}$ and $x_{bc}>0.5x_{cd}$ and so that the ratio $R(x)=1-[E_{1(x)}/P_{1(x)}]/[E_{1(x)}/P_{1(x)}+H_c+E_{2(x)}/P_{2(x)}]$ increases continuously or discontinuously, without a decreasing part, from a value of $R_{ab}$ at the start ($x=x_{ab}$) of the said interval to a value $R_{bc}$ at the end ($x=x_{bc}$) of the said interval.

This is the first general embodiment of the invention.

Preferably, the width $W_e(x)$ of the said electrode element is constant within the said range of x values.

Preferably, $R(x')-R(x)>0.001$ whatever x and x' are, chosen between $x_{ab}$ and $x_{bc}$, such that $x'-x=10$ μm.

Preferably, $R_{bc}>R_{ab}$, $R_{ab}>0.9$, and $(R_{bc}-R_{ab})<0.1$. These features enable the voltages necessary for ignition to be limited.

Preferably, the values of R(x) for any x such that $x_{bc}<x<x_{cd}$ are strictly greater than the values of R(x) for any x such that $0<x<x_{ab}$.

Preferably, the values of R(x) for any x such that $x_{bc}<x<x_{cd}$ are strictly greater than the values of R(x) for any x such that $0<x<x_{ab}$.

The subject of the invention is also a coplanar electrode plate with the specific longitudinal capacitance C(x) of the dielectric layer increasing as defined above, in which, for each electrode element of each discharge region, the said dielectric layer has a constant dielectric constant P1 and a constant thickness E1 expressed in microns above the said electrode element, at least for any x such that $x_{ab}<x<x_{bc}$, and in which, with the following definitions:

the normalized surface potential $V_{norm}(x)$, defined as the ratio of the surface potential V(x) at a level x of the dielectric layer for the electrode element in question to the maximum potential $V_{0\text{-}max}$ that would be obtained along the Ox axis for an electrode element of infinite width, the normalized surface potential $V_{norm}(x)$ then increasing from a value of $V_{n\text{-}ab}=V_{ab}/V_{0\text{-}max}$ at the start ($x=x_{ab}$) of the said interval to a value of $V_{n\text{-}bc}=V_{bc}/V_{0\text{-}max}$ at the end ($x=x_{bc}$) of the said interval;

an ideal width profile of this element, defined by the equation:

$$W_{e\text{-}id\text{-}0}(x)=W_{e\text{-}ab}\exp\{29\sqrt{(P1/E1)}\,(x-x_{ab})\times(V_{n\text{-}bc}-V_{n\text{-}ab})/(x_{bc}-x_{ab})\}$$

where $W_{e\text{-}ab}$ is the total width of the said element, measured at $x=x_{ab}$ perpendicular to the Ox axis; and a lower limit profile $W_{e\text{-}id\text{-}low}$ and an upper limit profile $W_{e\text{-}id\text{-}up}$, defined by the equations: $W_{e\text{-}id\text{-}low}=0.85W_{e\text{-}id\text{-}0}$ and $W_{e\text{-}id\text{-}up}=1.15W_{e\text{-}id\text{-}0}$, then, for any x between $x_{ab}$ and $x_{bc}$ inclusive, the total width $W_e(x)$ of the said element, measured at x perpendicular to the Ox axis, is such that:

$$W_{e\text{-}id\text{-}low}(x)<W_e(x)<W_{e\text{-}id\text{-}up}(x).$$

This is the second general embodiment of the invention.

The width $W_e(x)$ of the electrode element may be discontinuous, for example when the said element is subdivided into two lateral conducting elements. The sum of the width of each lateral conducting element is then taken.

It has been found that any electrode element profile lying between this lower limit profile $W_{e\text{-}id\text{-}low}$ and this upper limit profile $W_{e\text{-}id\text{-}up}$ makes it possible to achieve a continuous or discontinuous increasing distribution of the potential between the start ($x=x_{ab}$) and the end ($x=x_{bc}$) of the said interval according to the essential general feature of the invention.

The invention may also have one or more of the following features:

the width $W_{e\text{-}ab}$ is less than or equal to 80 μm; and the width $W_{e\text{-}ab}$ is less than or equal to 50 μm, thereby making it possible to advantageously limit the amount of energy dissipated at the start of the discharge when such an electrode plate is incorporated into a plasma display panel.

Preferably, the said electrode element is subdivided into two lateral conducting elements that are symmetrical with respect to the Ox axis and are separate at least in the region where x lies within the $[x_{ab},x_{b3}]$ interval where $x_{b3}-x_{ab}>0.7(x_{bc}-x_{ab})$. Preferably, $x_{b3}=x_{bc}$.

Preferably, if Oy is an axis transverse to the Ox axis lying along the ignition edge and letting $d_{e\text{-}p}(x)$ be the distance, measured parallel to the Oy axis at any position x lying between $x_{ab}$ and $x_{bc}$, between the edges turned towards each other of these two lateral conducting elements, a value $x=x_{b2}$ lying between $x_{ab}$ and $x_{b3}$ exists such that $d_{e\text{-}p}(x)>d_{e\text{-}p}(x_{ab})$ for any value of x lying between $x_{ab}$ and $x_{b2}$. Thus, the lateral conducting elements move away from one another progressively and then towards one another beyond $x=x_{b2}$.

The invention may also have one or more of the following features:

$d_{e\text{-}p}(x_{ab})$ lies between 100 μm and 200 μm;

considering the mean line of each lateral conducting element traced, for a given position x, at mid-distance between the lateral edges of this lateral element, in the region where $x_{ab}<x<x_{b2}$, the tangent at x to the mean line of this element makes an angle of less than 60° with the Ox axis;

the said angle lies between 30° and 45°; this feature avoids any interference with the displacement of the cathode sheath in the expansion region when the said electrode plate is incorporated into a plasma display panel.

The subject of the invention is also a coplanar-discharge electrode plate for defining discharge regions in a plasma display panel, which comprises:

at least a first and a second array of coplanar electrodes that are coated with a dielectric layer and the general directions of which are parallel, where each electrode of the first array is adjacent to an electrode of the second array, is paired with it and is intended to supply a set of discharge regions;

for each discharge region, at least two electrode elements that have a common longitudinal axis of symmetry Ox, each connected to an electrode of a pair, characterized in that, for each electrode element of each discharge region, the point O on the Ox axis being located on what is called an ignition edge of the said electrode element facing the other electrode element of the said discharge region and the Ox axis being directed towards what is called an end-of-discharge edge that delimits the said element on the opposite side from the said discharge edge and is positioned at $x=x_{cd}$ on the Ox axis, the said electrode element is subdivided into two lateral conducting elements that are symmetrical with respect to the Ox axis and separate at least in a region where x lies within an interval $[x_{ab},x_{b3}]$, if Oy is an axis transverse to the Ox axis lying along the ignition edge and letting $d_{e-p}(x_{ab})$ be the distance, measured parallel to the Oy axis at a position $x=x_{ab}$ between the edges turned towards each other of the two lateral conducting elements, the said electrode element comprises a transverse bar called an ignition bar which connects the said lateral conducting elements, one edge of which corresponds to the said ignition edge, and the length of which, measured along the Ox axis, is greater by a value $\Delta L_a$ for $|y|$ lying between 0 and $y_1$ on either side of the Ox axis than a value $L_a$ of this length for $|y|$ lying between $y_1$ and $d_{e-p}(x_{ab})/2$ on either side of the Ox axis.

The electrode element then includes a projection at the centre of the transverse ignition bar, positioned between the two lateral conducting elements. Preferably, if $W_e(x_{ab})=W_{e-ab}$, then $W_{e-ab}<L_a\leqq 80$ μm. Preferably, $\Delta L_a>0.2L_a$. Preferably, the width $W_{a-i}=2y_1$ of the projection, measured along the Oy axis, is such that $W_{e-ab}<W_{a-i}<80$ μm, where $W_{e-ab}=2W_{e-p0}$.

The subject of the invention is also a plasma display panel provided with a coplanar electrode plate in which the profile of all the electrode elements is in accordance with the invention.

The subject of the invention is also a plasma display panel comprising a coplanar electrode plate and an address electrode plate defining discharge regions between them and being separated by a distance $H_c$, the coplanar electrode plate comprising:

at least a first and a second array of coplanar electrodes that are coated with a dielectric layer and the general directions of which are parallel, where each electrode of the first array is adjacent to an electrode of the second array, is paired with it and is intended to supply a set of discharge regions;

for each discharge region, at least two electrode elements that have a common longitudinal axis of symmetry Ox, each connected to an electrode of a pair, the address electrode plate comprising:

an array of address electrodes that are coated with a dielectric layer and are each oriented and positioned so that each crosses a pair of electrodes of the coplanar electrode plate in one of the said discharge regions;

an array of parallel barrier ribs, each being placed between two adjacent address electrodes at a distance $W_c$ from two other adjacent barrier ribs, and, for each electrode element of each discharge region, the point O on the Ox axis being located on what is called an ignition edge of the said electrode element facing the other electrode element of the said discharge region and the Ox axis being directed towards what is called an end-of-discharge edge that delimits the said element on the opposite side from the said discharge edge and is positioned at $x=x_{cd}$ on the Ox axis, characterized in that the said dielectric layer has a homogeneous composition and a constant thickness above the said electrode element, at least for any x such that $x_{ab}<x<x_{bc}$, and in that, for each discharge region of the said display panel and for each electrode element of this region, the said electrode element is subdivided into two lateral conducting elements of constant width $W_{e-p0}$ that are symmetrical with respect to the Ox axis and are separate in a region where x lies within an interval $[x_{ab},x_{bc}]$ and in that, if Oy is an axis transverse to the Ox axis lying along the ignition edge and letting $d_{e-p}(x)$ be the distance, measured parallel to the Oy axis at any position x lying between $x_{ab}$ and $x_{bc}$, between the edges turned towards each other of these two lateral conducting elements, $d_{e-p}(x)$ increases in a continuous or discontinuous manner as a function of x in the said $[x_{ab}, x_{bc}]$ interval, and in that, considering the mean line of each lateral conducting element traced, for a given position x, at mid-distance between the lateral edges of this lateral element, in the region where $x_{ab}<x<x_{bc}$, the tangent at x to the mean line of this element makes an angle of between 20° and 40° with the Ox axis, and in that $d_{e-p}(x_{ab})\leqq 350$ μm.

This is the third general embodiment of the invention.

Thanks to the relatively short distance that separates them, the electrostatic effect of one lateral conducting element on the other is sufficiently strong here to allow, according to the invention, a variation in the normalized potential at the surface of the dielectric between $V_{n-ab}$ of preferably greater than 0.9 and $V_{n-bc}$ of preferably close to 1, while still keeping the width of each lateral conducting element constant.

Preferably, 200 μm$<d_{e-p}(x_{ab})\leqq 350$ μm and the said electrode element comprises a transverse bar called an ignition bar which connects the said lateral conducting elements, one edge of which corresponds to the said ignition edge, and the length of which, measured along the Ox axis, is greater by a value $\Delta L_a$ for $|y|$ lying between 0 and $y_1$ on either side of the Ox axis than a value $L_a$ of this length for $|y|$ lying between $y_1$ and $d_{e-p}(x_{ab})/2$ on either side of the Ox axis.

According to this feature, the electrode element therefore includes a projection at the centre of the transverse ignition bar, positioned between the two lateral conducting elements. This projection then functions as a discharge initiator, which causes no additional dissipation of energy for the expansion. For this purpose, it is preferable for the elongation $\Delta L_a$ to be chosen so that $\Delta L_a+L_a<80$ μm and so that the width $W_{a-i}=2y_1$ of the projection, measured along the Oy axis, is such that $W_{e-ab}<W_{a-i}<80$ μm, where $W_{e-ab}=2W_{e-p0}$.

Preferably, if $W_a$ is the width of the said ignition bar measured along the Oy axis, if $L_a<2W_{e-p0}$, $\Delta L_a>2W_{e-p0}-L_a$ if $L_a>2W_{e-p0}$, $\Delta L_a>0.2L_a$.

In such a plasma display panel, these geometrical characteristics make it possible to reduce the ignition voltage without significantly increasing the energy dissipation in the cathode sheath at the start of the discharges, especially because the displacement of this sheath at the moment of expansion must be shifted laterally, outside the region of the projection, at each of the lateral conducting elements. The increase in the memory charge at the centre of the transverse ignition bar at this projection will have no unfavourable impact on the energy of the cathode sheath.

The subject of the invention is also a plasma display panel comprising a coplanar electrode plate and an address electrode plate defining discharge regions between them and being separated by a distance $H_c$, the coplanar electrode plate comprising:

at least a first and a second array of coplanar electrodes that are coated with a dielectric layer and the general directions of which are parallel, where each electrode of the first array is adjacent to an electrode of the second array, is paired with it and is intended to supply a set of discharge regions;

for each discharge region, at least two electrode elements that have a common longitudinal axis of symmetry Ox, each connected to an electrode of a pair, the address electrode plate comprising:

an array of address electrodes that are coated with a dielectric layer and are oriented and positioned so that each crosses a pair of electrodes of the coplanar electrode plate in one of the said discharge regions;

an array of parallel barrier ribs, each being placed between two adjacent address electrodes at a distance $W_c$ from two other adjacent barrier ribs, and, for each electrode element of each discharge region, the point O on the Ox axis being located on what is called an ignition edge of the said electrode element facing the other electrode element of the said discharge region and the Ox axis being directed towards what is called an end-of-discharge edge that delimits the said element on the opposite side from the said discharge edge and is positioned at $x=x_{cd}$ on the Ox axis, characterized in that the said dielectric layer has a homogeneous composition and a constant thickness above the said electrode element, at least for any x such that $x_{ab}<x<x_{bc}$, and in that, for each discharge region of the said panel and for each electrode element of this region, the said electrode element is subdivided into two lateral conducting elements of constant width $W_{e\text{-}p0}$, the distance $d_{e\text{-}p0}$ between the edges of which that are turned towards each other is constant and greater than $W_c$, which elements are symmetrical with respect to the Ox axis and separate in the region where x lies within the $[x_{ab},x_{bc}]$ interval, and in that the said electrode element comprises:

a transverse bar called an ignition bar, the width of which is greater than or equal to $W_c$, the length of which measured along the Ox axis is $L_a$ and one edge of which corresponds to the said ignition edge;

a transverse bar called a discharge stabilization bar, the width of which is greater than or equal to $W_c$, the length of which, measured along the Ox axis, is $L_s$, and one edge of which corresponds to the said end-of-discharge edge; and at least one intermediate transverse bar, the width of which is greater than or equal to $W_c$ and the position of which, along the Ox axis, lies entirely within the $[x_{ab},x_{bc}]$ interval over its entire length $L_b$; and in that $L_b \leqq L_a < L_c$.

This is the fourth general embodiment of the invention.

Since $L_s>L_a$, the capacitance of the dielectric layer located in the end-of-discharge region is greater than the specific capacitance of the dielectric layer located in the discharge ignition region so as to establish a positive potential difference between the ignition region and the end-of-discharge region.

Preferably, with one of the edges of the intermediate transverse bar being at a distance $d_1$ from the said discharge stabilization bar and the other edge being at a distance $d_2$ from the said ignition bar, then $d_2/2<d_1<d_2$.

Preferably, $3\times\max(L_a,L_b)<L_s>5\times\max(L_a,L_b)$

Apart from the features already mentioned of one or other of the plasma display panels according to the invention, this display panel comprises an address electrode plate defining with the coplanar electrode plate discharge regions and, for each discharge region and for each electrode element, if $W_{e\text{-}ab}$ is the width of the said electrode element, measured along the Ox axis at the position $x=x_{ab}$ at the start of the said interval of values of x, the said electrode element preferably comprises a transverse bar called an ignition bar, one edge of which corresponds to the said ignition edge and the length of which, measured along the Ox axis, is such that: $W_{e\text{-}ab}<L_a<80$ μm. Strictly speaking, $L_a<x_{ab}$ since the position $x=x_{ab}$ corresponds to the start of the expansion region just after the end of the ignition region.

Advantageously, this feature makes it possible to maintain a surface potential on the dielectric layer in the ignition region that is identical to the surface potential at the start of the expansion region.

Preferably, this display panel includes an array of parallel barrier ribs placed between the said electrode plates at a distance $W_c$ from one another, perpendicular to the general direction of the said coplanar electrodes, characterized in that, if Oy is an axis transverse to the Ox axis lying along the ignition edge and if $W_a$ is the width of the said transverse ignition bar, measured along the Oy axis, then: $W_c-60$ μm$<W_a \leqq W_c-100$ μm.

Preferably, the plasma display panel includes an array of parallel barrier ribs placed between the said electrode plates at a distance $W_c$ from one another, perpendicular to the general direction of the said coplanar electrodes, characterized in that, if Oy is an axis transverse to the Ox axis lying along the ignition edge, if $W_a$ is the width of the said transverse ignition bar measured along the Oy axis and if $W_{a\text{-}min}$ corresponds to the width beyond which the said barrier ribs cause a substantial reduction in the surface potential of the dielectric layer above the said element, the said transverse ignition bar comprises:

a central region $Z_{a\text{-}c}$ for which, at any point $|y|<W_{a\text{-}min}/2$, the distance, along the Ox axis, between the ignition edges of the two electrode elements of the said discharge region is constant and equal to $g_c$; and two lateral regions $Z_{a\text{-}p1}$, $Z_{a\text{-}p2}$ on either side of the central region $Z_{a\text{-}c}$, for which, at any point $|y|>W_{a\text{-}min}/2$, the distance, along the Ox axis, between the ignition edges of the two electrode elements of the said discharge region decreases continuously from the value $g_c$.

By reducing the gap separating the two electrode elements in the lateral regions $Z_{a\text{-}p1}$, $Z_{a\text{-}p2}$ close to the barrier ribs it is possible to increase the electric field in this region and to compensate for the reduction in primary particles resulting from the wall effect, by locally adapting the Paschen conditions. Thus, a reduction in the ignition potential is obtained for a constant ignition region area, or a reduction in the ignition region area is obtained for a constant ignition potential.

Preferably, one or other of the plasma display panels according to the invention includes supply means suitable for generating series of constant-plateau sustain voltage pulses between the coplanar electrodes of the various pairs. Advantageously, the invention makes it possible for the luminous efficiency and the lifetime of the plasma display panels to be substantially increased, while using this conventional and inexpensive type of sustain pulse generator.

4/ BRIEF DESCRIPTION OF THE DRAWINGS

The invention will be more clearly understood on reading the description that follows, given by way of non-limiting example and for comparison with the prior art, and with reference to the appended figures in which:

FIGS. 1A and 1B show, in a top view and in a sectional view respectively, a first structure of a cell of the prior art;

FIG. 2A shows the state of a discharge at time T1 and at time T2 in a cell of the type shown in FIGS. 1A and 1B, and FIG. 2B shows the variation of the discharge current as a function of time T;

FIG. 3A shows, in a top view, a second structure of a cell of the prior art and FIG. 3B shows the variation of the discharge current as a function of time T in this structure;

FIG. 4A shows, in a top view, a third structure of a cell of the prior art and FIG. 4B shows the variation of the discharge current as a function of time T in this structure;

FIGS. 10A to 10D and 11A to 11D illustrate variants of a second general embodiment of the invention, based on a structure in which the electrode element has a variable width;

FIG. 12 shows the variation in the normalized ignition potential to be applied between the electrode elements of a cell in order to ignite discharges, as a function of the width of the electrode element in the ignition region;

FIGS. 13 and 14 show two possible configurations of the ignition edge of electrode elements according to the invention;

FIGS. 15A, 15B illustrate variants of the structure according to FIG. 10C, which here are provided with ignition edges shown in FIG. 13 or FIG. 14;

FIGS. 16 and 18A to 18G illustrate other variants of a second general embodiment of the invention, based on a structure in which the electrode element has a variable width and is subdivided into two lateral conducting elements;

FIG. 17 shows the variation in the surface potential of the dielectric layer at the centre of the cell of FIG. 16 as a function of the gap between the two lateral conducting elements;

5/ DETAILED DESCRIPTION OF THE PREFERRED EMBODIMENTS

Figure 5:
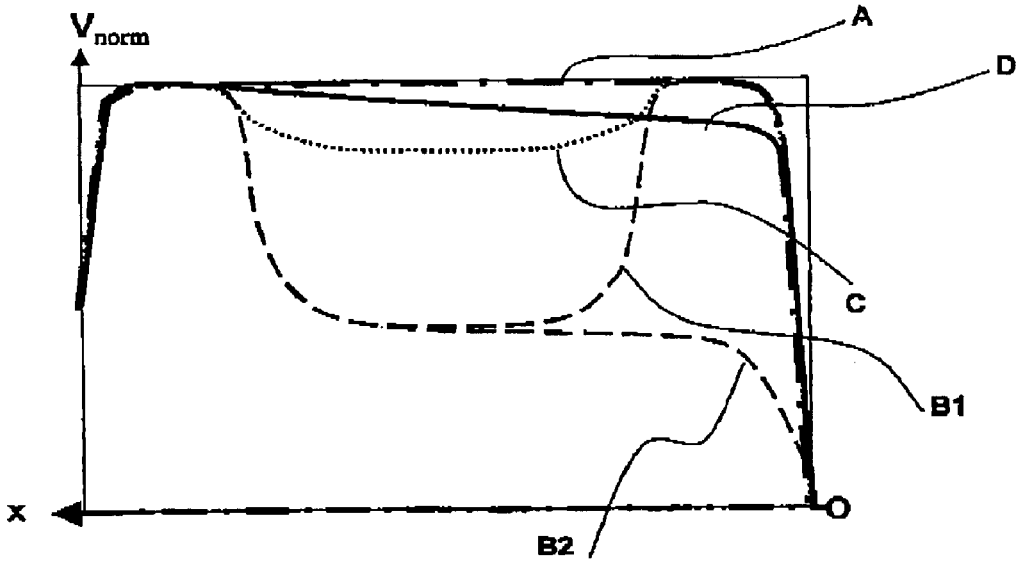
PRIOR ART Fig.5
FIG. 5 shows the distribution of the surface potential of the dielectric layer along the electrode elements of the structures of the prior art of FIGS. 1 to 4.

To simplify the description and to bring about the differences and advantages that the invention has over the prior art, identical references will be used for the elements that fulfil the same functions.

When a coplanar-discharge electrode plate is used in a plasma display panel, each plasma discharge, which arises between the electrodes of one pair, one serving as cathode and the other as anode, comprises an ignition phase and an expansion phase. FIG. 2A shows a schematic longitudinal section of a cell of the type with a coplanar discharge region, as described in FIG. 1A, FIG. 2B showing the variation in the electrical current between the coplanar electrodes of this cell during a sustain discharge.

The ignition voltage of a discharge obviously depends on the electrical charges stored beforehand on the anode and the cathode in the vicinity of the ignition region, especially during the previous discharge in which the cathode was an anode, and vice versa. Before the discharge, positive charges are therefore stored on the anode and negative charges on the cathode, these stored charges creating what is called a memory voltage. The ignition voltage corresponds to the voltage applied between the electrodes—or sustain voltage—plus the memory voltage.

At the moment of ignition, the electron avalanche in the discharge gas between the electrodes then creates a positive space charge that is concentrated around the cathode, to form what is called the cathode sheath. The plasma region called the positive pseudo-column located between the cathode sheath and the anode end of the discharge contains positive and negative charges in identical proportions. This region therefore conducts current and the electric field therein is low. The positive pseudo-column region therefore has a low electron energy distribution and consequently favours the production of ultraviolet photons, thereby promoting excitation of the discharge gas.

Most of the electric field in the gas between the anode and the cathode therefore corresponds to the field within the cathode sheath. Along the field lines between the anode and the cathode, the largest part of the potential drop corresponds to the cathode sheath region. The impact of the ions, accelerated in the intense field of the cathode sheath, on the magnesia-based layer that coats the dielectric layer causes substantial emission of secondary electrons near the cathode. The effect of this intense electron multiplication is then to greatly increase the density of the conducting plasma between the electrodes, both in terms of ions and electrons, thereby causing the cathode sheath to contract in the vicinity of the cathode and causing this sheath to be positioned at the point where the positive charges of the plasma are deposited on the dielectric surface portion covering the cathode. On the anode side, the electrons of the plasma, which are much more mobile than the ions, are deposited on the dielectric surface portion covering the anode in order to progressively neutralize, from the front rearwards, the layer of positive "memory" charges stored beforehand. When all this stored positive charge is neutralized, the potential between the anode and the cathode then starts to decrease and the electric field in the cathode sheath then reaches a maximum, corresponding to the maximum contraction of the sheath, and the electrical current between the electrodes is also a maximum. The contraction of this sheath is accompanied by a substantial increase in the energy of the ions, which is dissipated in the accelerating electric field between the cathode sheath and the surface of the magnesia, and this results in substantial degradation by ion sputtering of the magnesia surface. Referring to FIG. 2B, at the initial time T1 of the maximum initial current I1, and therefore of the maximum energy deposited in the discharge, the positive pseudo-column region is small and the energy efficiency of the discharge is therefore also low.

Before formation of the discharge, the distribution of the potential along the longitudinal axis of symmetry Ox at the surface of the dielectric layer covering the cathode is uniform, as will be explained in greater detail later on with reference to curve A of FIG. 5. Since, before the start of this discharge, the potential is thus constant along the discharge expansion axis Ox, there is therefore no transverse electric field for displacing the cathode sheath. The positive charge coming from the discharge is therefore deposited and therefore progressively builds up in the ignition region $Z_a$ without there being any displacement of the sheath. The ignition region $Z_a$ therefore corresponds to the region of ion accumulation at the start of the discharge, throughout the duration when the cathode sheath of this discharge is not displaced. The ion bombardment is then concentrated in a small area of the magnesia layer and causes strong local sputtering of the said layer. Under the effect of the positive charges that accumulate on the dielectric surface portion located beneath the cathode sheath, a "transverse" field is then created between these positive charges, all just deposited, on the one hand and the negative charges, deposited beforehand, on the cathode, for example during the preceding discharge, and the potential applied to this cathode, on the other. Beyond a transverse field threshold which corresponds to a threshold of the density of positive charges accumulated on the cathode near this sheath, this transverse field causes a cathode sheath to be displaced further and further away from the ignition region as the ionic charges accumulate on the dielectric surface covering the cathode. It is this displacement that causes the plasma discharge to expand. The cathode sheath is positioned at the point where the ions of the plasma are deposited, at the boundary of the expansion region. During the discharges, the displacement of the cathode sheath follows the line of the electrode elements in each cell. The expansion region $Z_b$ therefore corresponds to the region swept by the displacement of the cathode sheath of the discharge.

On the opposite side from the ignition edge, each electrode element comprises an end-of-discharge edge. At the end of displacement of the cathode sheath, the discharge has not in general been extinguished because the surface potential of the dielectric layer at the end of this displacement still has, relative to the surface potential of the dielectric layer covering the anode, a high enough difference to sustain this discharge. In other words, because the overall deposition of ions on the dielectric layer covering the cathode has not yet sufficiently compensated for the potential applied to this cathode, the discharge then continues without displacement of the cathode sheath over a surface region of the cathode corresponding to what is called the stabilization region or end-of-discharge region $Z_c$. Strictly speaking, this "end-of-discharge region" becomes the "stabilization region" only when, before the start of a discharge, the surface potential of the dielectric layer in this region is greater than that of the rest of the dielectric layer in the expansion and ignition region. If this is not the case, the end-of-discharge region is only the end of the expansion region, and not strictly speaking a stabilization region.

If the discharge starts at time T=0 then a time T1 is defined as the end-of-ignition time or start-of-expansion time, and a time T2 is defined as the end-of-expansion time or start-of-stabilization time. Referring to FIG. 2B, the expansion of the plasma over the surface of the dielectric layer, between time T1 and time T2, makes it possible to extend the positive pseudo-column region of the discharge, and therefore to increase the electrical energy part of this discharge which is dissipated in order to excite the gas in the cell, and therefore to improve the efficiency of ultraviolet photon production in the discharge. The expansion of the discharge also makes it possible to distribute the ion bombardment sputtering of the magnesia layer over a larger area and to reduce the local degradation, thereby increasing the lifetime of the said layer and consequently that of plasma display screens. In the case of the structure described in FIGS. 2A, 2B, the amount of energy dissipated at time T2, which corresponds to the electrical current I2 at this instant, remains small. Of all the energy dissipated during the discharge, only a small part is therefore dissipated during the times when this discharge is sufficiently extended in order to have a high ultraviolet photon production efficiency and a low magnesia layer sputtering rate. One means of improving the luminous efficiency and the lifetime therefore consists in reversing the distribution of the energy dissipated during the initiation of the discharges, or to aim to have an I1/I2 ratio of minimum value. In particular, maximum energy should be dissipated in the discharge when the latter is at its point of optimum expansion, that is to say at time T2 when the discharge leaves the expansion region $Z_b$ and enters the stabilization region $Z_c$.

The rate of formation of the transverse field for spreading the discharge over the surface of the dielectric layer covering the cathode depends on the local capacitance of the dielectric layer located beneath the cathode sheath, in the ignition region like at any point in the expansion region. The higher this local capacitance, the greater the quantity of charge deposited and the longer the time needed to increase the transverse sheath displacement field. This local capacitance determines the surface potential seen by the discharge. If the local capacitance is uniform, no transverse electric field exists and the formation of this transverse electric field depends entirely on the potential difference generated by the charge stored beforehand on the surface of the dielectric layer coming from the previous discharge and the charge deposited by the current discharge. In other words, the transverse field, and therefore discharge spreading, can exist only if a sufficient amount of electrical energy is injected in order for the surface of the dielectric layer to be fully charged locally.

Moreover, as mentioned it is necessary to dissipate the maximum energy in the discharge at time T2 when the discharge leaves the expansion region $Z_b$ and enters the stabilization region $Z_c$. For this purpose, it is therefore necessary that the capacitance of the dielectric layer in the stabilization region $Z_c$ be greater than the capacitance of the dielectric layer in any other part of the discharge region.

In the case of a cell having the structure of FIGS. 1A, 1B of the prior art, the discharge region $Z_b$ extends along an electrode element that has a uniform width over the entire half-length of the cell, so that the local capacitance of the dielectric layer portion 13 lying between this electrode element and the cathode sheath has a constant value at any point in the ignition region and in the expansion region, whatever the position of the cathode sheath during its expansion period, that is to say whatever the state of the discharge. For a given constituent dielectric material of the dielectric layer 13 covering the electrode element, this local capacitance is always a maximum since the electrode element corresponds to the entire discharge region. The distribution of the potential at the surface of the dielectric layer covering the electrode element of the discharge region is shown by curve A in FIG. 5 at a time T immediately preceding the start of the discharge and as a function of the distance x from the ignition edge, measured on the Ox axis in FIG. 1-A, which here is a longitudinal axis of symmetry of the electrode element of the cell in question. This distribution is obtained using 2D modelling software called SIPDP2D version 3.04 from Kinema Software, the operation of which is described later. It may be seen that this surface potential is uniform and constant over the entire length of the electrode element, since the local capacitance of the dielectric layer is constant at any point on the surface of this layer, and no transverse electric field favourable to displacement of the discharge over the surface of the dielectric layer after the ignition phase exists. The discharge current shown in FIG. 2B then possesses the characteristics described above, whereby a large part of the electrical energy is dissipated before the transverse discharge spread field is formed sufficiently to cause displacement of the sheath, and a small part of the electrical energy is dissipated during the displacement and at the end of the displacement of the sheath, while the discharge is reaching the maximum luminous efficiency. The I1/I2 ratio is then high.

In the structure of the cell described in FIG. 3A, each electrode element Y or Y' has, perpendicular to the Ox axis, a width that is not uniform on moving along the mean direction of displacement of the discharge cathode sheath, that is to say along the Ox axis. The specific longitudinal capacitance of the dielectric layer covering an element of a coplanar electrode is meant the capacitance of a region of this layer extending over a very short distance dx positioned at x on the Ox axis corresponding to a length slice and extending over a width $W_e(x)$ corresponding to that of the electrode element in the same x position on the Ox axis. In the present case, the specific longitudinal capacitance of the dielectric layer covering the electrode element shown in FIG. 3A is high in the ignition region $Z_a$ where the electrode element consists of the first transverse bar 31, then low in the expansion region $Z_b$ where the electrode element consists of the central leg 32 and finally high again in the end-of-discharge region $Z_c$ where the electrode element is formed by the second transverse bar 33. The variation in electrical current I of the discharge as a function of time T of this discharge is shown in FIG. 3B for the cell structure of FIG. 3A. The distribution of the potential V on the surface of the dielectric layer covering the electrode element Y is shown as curve C by the dotted lines in FIG. 5 at a time preceding the start of a discharge. It may be seen that this distribution has a "hollow" in the expansion region, which forms a potential barrier between the ignition region and the stabilization region. The discharge is initiated above the dielectric surface covering the ignition region $Z_a$. It has been found that, since the expansion region formed by the leg 32 between the two transverse bars 31, 33 has a low specific longitudinal capacitance at any x position, the surface potential of the dielectric layer covering this leg is less than or equal to that of the dielectric layer covering the transverse bar 31 of the ignition region, depending on whether the width of this leg 32 is respectively strictly less than or greater than the length of the transverse bar 31 in the ignition region in the cell. At the transition between the ignition region $Z_a$ and the expansion region $Z_b$ there is therefore either a transverse field away from the discharge expansion direction Ox along the dielectric surface covering the leg 32, or a zero transverse field. For this structure, there is therefore a transverse field allowing the discharge to spread only when a potential difference is generated by the accumulation of deposited negative charges and then positive charges. Such charge deposition can be obtained only by dissipating a large part of the electrical energy of the discharge in the ignition region, so that the current I1 remains high. In contrast, since the longitudinal capacitance of the electrode element is low in the region of the leg 32 of the expansion region $Z_b$, the charge deposition in this region is rapid and therefore the transverse field needed for displacing the sheath is rapidly created at any point in this region, thereby promoting the rapid displacement of the cathode sheath along the leg 32 as far as the second transverse bar or bus 33.

The smaller the width of the leg 32, the lower the specific longitudinal capacitance and the more rapid the rate of displacement of the cathode sheath. When the width of the leg 32 is greater than the length of the transverse bar 31 in the cell (which constitutes the ignition region $Z_a$), the behaviour of the discharge is similar to that described in the case of the structure of FIG. 1A (zero transverse field). Of interest here are only the cases in which the width of the leg 32 is less than or equal to the length of the transverse bar of the ignition region $Z_a$. Moreover, before the start of each discharge, the same type of potential distribution indicated by curve C in FIG. 5, which presents a potential barrier, is found at the anode. The reverse potential difference generated by the leg 32 disturbs the spreading of the electrons at the anode. This is because, at the start of the discharge, the electrons no longer immediately spread out over the entire anode, as in the structure of FIG. 1, but only over that part of the anode element that is located upstream of the potential barrier, namely over the part located at the first transverse bar and then, as soon as the accumulated charge on the anode allows the potential barrier to be exceeded, the electrons rapidly spread out over the rest of the anode and the potential difference, between the surface of the dielectric layer located above the anode and the surface of the dielectric layer located above the cathode at the position of the sheath, rapidly decreases. Since, along the field lines between the anode and the cathode, the largest part of the potential drop corresponds to the cathode sheath region, the electric field within this sheath rapidly decreases as charges are deposited on the anode, thereby causing expansion of this sheath, a reduction in the energy of the ions striking the magnesia layer and a reduction in the rate of charge production on this layer. Owing to the effect of this expansion, the rate of displacement of the cathode sheath decreases in turn, and the discharge is extinguished before having reached the second transverse bar. To reach the second transverse bar 33 at the edge of the expansion region, the potential applied between the electrodes must be increased so as to compensate for the low longitudinal capacitance of the electrode element at the leg 32 and the rapid reduction in the electric field in the cathode sheath caused by the rapid deposition of electrons on the anode. Since the second transverse bar 33 forming the end-of-discharge region $Z_c$ has a high specific longitudinal capacitance, the elongated discharge is immobilized on this bar until the charge deposition on the dielectric surface covering the second transverse bar 33 has completely compensated for the potential applied between the electrodes. The electrical energy part of the discharge dissipated at the end of the expansion period is therefore increased, and the intensity of the electrical current I2 increases.

As illustrated in FIG. 3B, the I1/I2 ratio then decreases owing to the increase in I2. However, a large part of the electrical energy of the discharge remains lost in the ignition region in order to deposit charges on the dielectric surface and to create a transverse field high enough to allow the cathode sheath to pass from the first bar 31 to the second transverse bar 33, and thus overcome the potential barrier generated by the leg 32.

FIG. 4A shows a structure similar to that described in FIG. 3A. Instead of a single leg centred on the Ox axis for connecting the two same transverse bars, there are two legs 42*a*, 42*b* shifted to the boundary of the cell and positioned here on the top of the barrier ribs 15. The potential distribution, before the start of a discharge, at the surface of the dielectric layer covering the electrode element consisting of these two transverse bars and these two legs is obtained using the same SIPDP-2D software mentioned previously. This distribution is shown as curve B1 in FIG. 5. The Ox axis corresponds overall to the axis of symmetry of the cathode sheath displacement region. This potential distribution presents here a higher potential barrier between the two transverse bars, resulting from the absence of a leg at the centre of the discharge region between the said bars. The potential drop between the two bars is nevertheless limited by the presence of the legs 42*a*, 42*b* that are positioned along the walls of the cell. The intensity of the electrical current I generated by the discharge is shown in FIG. 4B as a function of time T.

The discharge is initiated on the surface of the dielectric layer covering the first transverse bar (ignition region $Z_a$), as previously, and then comes up against the potential barrier caused by the absence of a central leg. Since the electrons cannot spread out over the anode, the discharge is rapidly extinguished. The transverse electric field here is away from the discharge expansion direction from the front of the conducting element to the rear. To reverse this transverse field, it is necessary to deposit a sufficient amount of charge on the first transverse bar so as to compensate for the potential barrier. Therefore the same modelling software is again used to obtain the potential distribution during the discharge and just before the start of its expansion, which potential distribution, known as curve B2 in FIG. 5, allows the discharge to start to be displaced so as in this case to pass directly from the transverse bar constituting the ignition region $Z_a$ to the second transverse bar defining the end-of-discharge region $Z_c$, on which bar a second cathode sheath is created. This passage from the first transverse bar to the second transverse bar is accomplished without any energy loss and makes it possible to achieve substantial discharge spreading. However, it is necessary to greatly increase the potential applied to the electrodes so as to be able to jump the potential barrier and create and maintain the second cathode sheath on the second transverse bar. The first part of the discharge therefore takes place at a voltage very much above the normal operating voltage, with as consequence a substantial contraction of the cathode sheath on the first transverse bar and substantial sputtering of the magnesia surface by ion bombardment and a higher electrical current I1 than the current I2 of the second discharge. The I1/I2 ratio for this type of discharge is again improved thanks to the formation of a second discharge on the transverse bar constituting the end of the expansion region.

The luminous efficiency and the lifetime of plasma display panels are therefore improved by inverting the distribution of the energy dissipated during the discharges so as to dissipate a large part of the energy during the high discharge efficiency period, for example so that the I1/I2 ratio is a minimum. As will be explained later in greater detail, the aim of the invention is to maintain and control the transverse electric field for displacing the cathode sheath at a level high enough to rapidly elongate the discharge, while dissipating the minimum amount of electrical energy, and then to stabilize the discharge, once it has been elongated, and therefore to dissipate the maximum amount of electrical energy.

Figure 6:
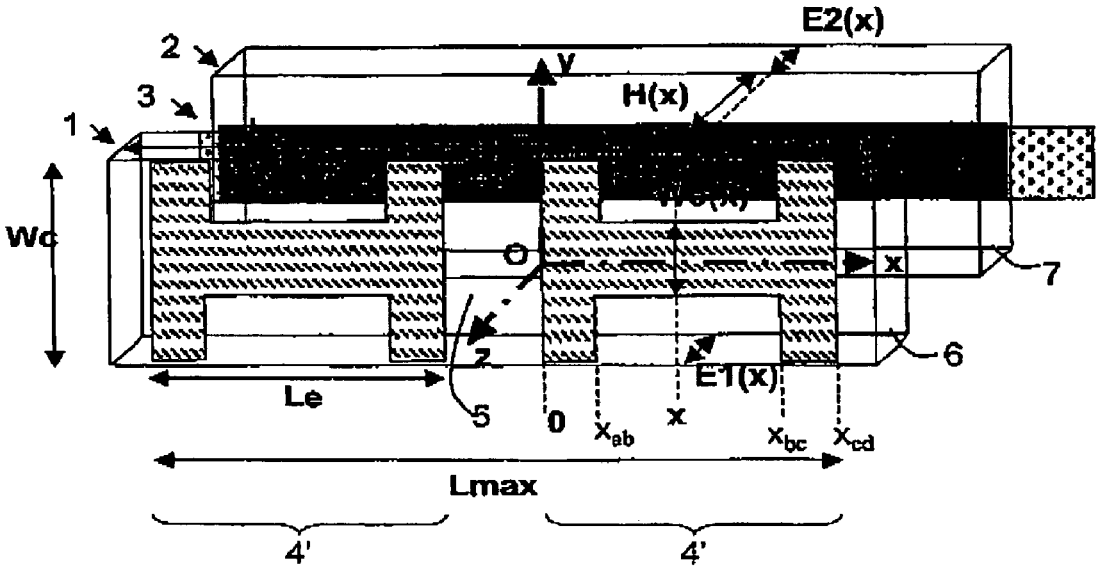
FIG. 6 shows a general perspective view of a cell of a plasma display panel with a coplanar electrode plate.

FIG. 6 shows schematically a discharge region 3 of rectangular shape bounded between its larger faces by a coplanar electrode plate 1 bearing a pair of symmetrical electrode elements 4, 4' placed on either side of an inter-electrode separation or gap 5 and by an address electrode plate 2 bearing, but not necessarily so, an address electrode X which is of general direction perpendicular to the electrode elements 4, 4' and is coated with a dielectric layer 7. The ends of the electrode elements away from the gap are electrically connected to a conducting bus $Y_c$ (not shown) that serves to supply them with voltage. The coplanar electrodes 4, 4' are coated with a dielectric layer 6.

The discharge region 3 is bounded not only by the electrode plates but also by barrier ribs placed perpendicular to the electrode plates (not shown) and thus forms a discharge cell.

Let $L_c$, $W_c$ and $H_c$ be the length, width and thickness of the discharge cell respectively. Each electrode element 4, 4' extends along the largest dimension of the cell, namely its length $L_c$. Let $L_e$ be the length of each electrode element along this dimension, between its ignition edge and its end-of-discharge edge. Let E1 be the thickness and let P1 be the relative permittivity of the dielectric layer above each electrode element 4, 4'. Let E2 be the thickness and P2 be the relative permittivity of the dielectric layer above the address electrode X, or above the electrode plate 2 in the absence of an address electrode. The distance $H_c$ therefore corresponds to the thickness of gas between the two electrode plates 1 and 2. The electrode elements 4, 4' shown in the figure are in the form of a T as in the prior art.

If O corresponds to the centre of the cell at the ignition edge, then Ox is an axis located at the surface of the coplanar electrode plate in the longitudinal plane of symmetry of the cell, which extends towards the end-of-discharge edge, Oy is an axis, also located at the surface of the coplanar electrode plate, generally transverse to the Ox axis, which extends along the ignition edge in the direction of a side wall of the cell, and Oz is an axis perpendicular to the surface of the coplanar electrode plate, which extends in the direction of the opposed electrode plate of the plasma display panel.

The invention proposes mainly to adjust the specific longitudinal capacitance of the dielectric layer covering the coplanar electrode elements of each cell so as to create, before the start of each discharge, a positive or zero transverse electric field at any point in the expansion region allowing the discharge to spread out rapidly from the ignition region as far as the end-of-discharge or stabilization region, with a minimum amount of energy dissipated in the ignition region and a maximum amount of energy dissipated in the end-of-discharge region $Z_c$ of high efficiency, while still using conventional sustain pulse generators delivering, between the electrodes of the various pairs, conventional sustain voltage pulses in which each pulse has a constant voltage plateau, without a pronounced increase in the applied electric potential.

To obtain rapid spreading of the discharges in the expansion region $Z_b$, it is proposed to create, on the surface of the dielectric layer and before the start of each discharge, a potential that increases continuously or discontinuously from the start of the expansion region $Z_b$, which corresponds to the $x_{ab}$ of the ignition region $Z_a$, as far as the end $x_{bc}$ of the expansion region, which corresponds to the start of the stabilization region $Z_c$.

According to the invention, over this interval of increase, no point has a negative potential gradient—this potential gradient is measured along the axis of symmetry Ox of the region of displacement of the discharge cathode sheath in the direction of displacement of this discharge on the opposite side from the ignition edge. Corresponding to this potential gradient is an electric field. According to the invention, this increase in potential may be continuous, as will be explained below with reference to curve C of FIG. 7, or discontinuous, by potential jumps, with at least one and preferably two potential plateaus between the start and the end of the expansion region.

Figure 7:
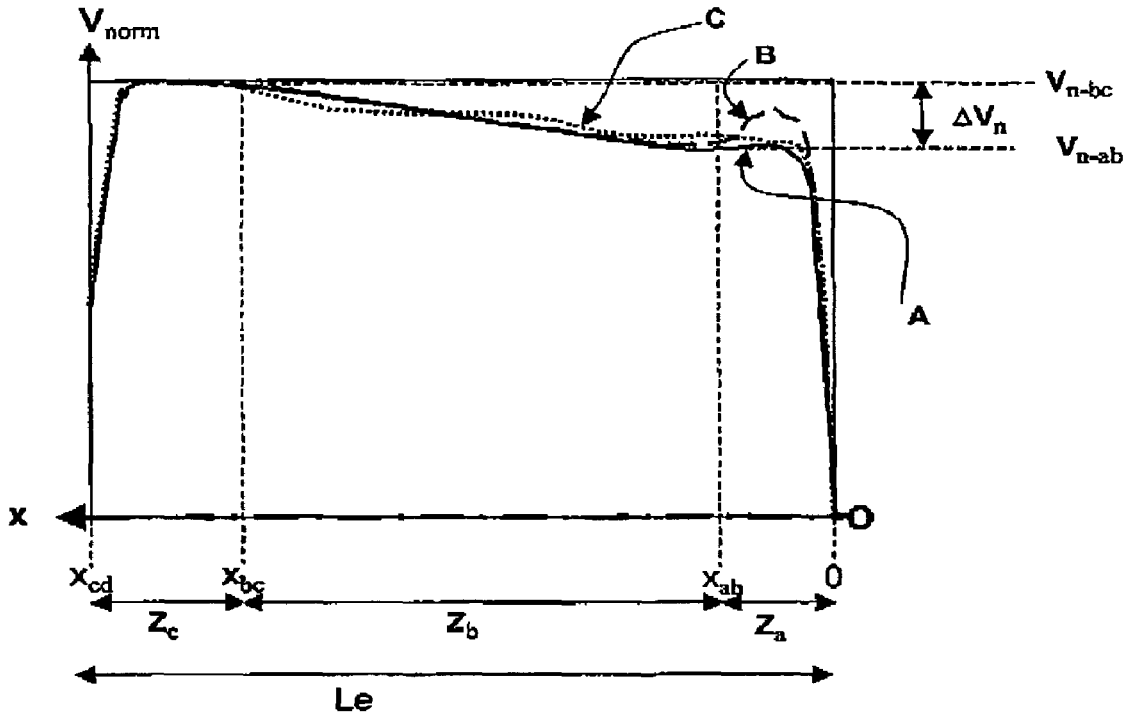
FIG. 7 shows the distribution of the surface potential according to the invention of the dielectric layer along the electrode elements of structures according to the invention that are described in the following figures.

Curve C, indicated by the dots in FIG. 7, gives an example of continuous increase of the potential corresponding to such a field that is strictly positive over the entire dielectric surface of the electrode plate 1 corresponding to the expansion region $Z_c$—this example will be developed later with reference to FIG. 8. Let $\Delta V$ be the potential difference of the surface of the dielectric layer between the start $x_{ab}$ and the end $x_{bc}$ of the expansion region, said difference being distributed according to the invention over this interval so as to generate, at any point in this interval, and for the same potential applied at any point of the electrode element 4 beneath the surface of the dielectric layer, a positive electric field directed along the Ox direction towards the end $x_{bc}$ Of the expansion region located on the opposite side from the ignition edge.

To obtain, before the start of each discharge, a potential that increases continuously or discontinuously from the start to the end of the expansion region $Z_b$ without modifying the potential applied to the electrode elements, the specific longitudinal capacitance of the dielectric layer covering the electrode elements in the expansion regions is varied in a manner suitable for obtaining this field. This is because the local capacitance determines the surface potential of the dielectric layer seen by the discharge.

Obtaining this increasing potential, or this positive electric field, along the discharge expansion axis Ox therefore assumes a specific longitudinal capacitance of the dielectric layer covering the electrode elements that increases from the start $x=x_{ab}$ to the end $x=x_{bc}$ of the expansion region $Z_b$. For each electrode element 4, the end $x_{ab}$ of the ignition region $Z_a$ and the start of the expansion region $Z_a$ correspond to the position x on this element from which the specific longitudinal capacitance starts to increase. For each electrode element 4, the end $x_{bc}$ of the expansion region $Z_b$ and the start of the stabilization or end-of-discharge region $Z_c$ correspond to the position x on this element at which the highest specific longitudinal capacitance is reached.

For each electrode element, an edge of the end of the stabilization region is defined and corresponds to a position $x=x_{cd}$—this edge is on the opposite side from the ignition edge positioned at x=0. Within each cell, as indicated in FIG. 6, $L_e=x_{cd}$ and $L_{max}$ is the distance that separates the edges of the end of the stabilization region of the two electrode elements 4, 4' of this cell.

Preferably, the end of the ignition region $x_{ab}$ is less than $L_e/3$ and the start of the end-of-discharge region $x_{bc}$ is greater than $L_e/2$. Furthermore, the length of the expansion region $(x_{bc}-x_{ab})$ represents more than one quarter of the total length $L_e$ of the electrode element, preferably more than half of this length.

The invention may also have one or more of the following features:

- $\Delta V$ is less than 10% of the highest potential $V_{max}$ of the surface of the dielectric layer along the Ox axis; the function of the upper limit of the potential difference $\Delta V$ is to limit the detrimental increase in the discharge ignition potential to below 20% of the voltage that it will be necessary to apply in order to obtain a discharge in a cell of identical structure but with a constant specific longitudinal capacitance according to the prior art. Preferably, a $\Delta V$ value corresponding to about 5% of the highest potential of the surface of the dielectric layer along the Ox axis is chosen;
- the electric field resulting from this potential difference $\Delta V$ is at any point greater than 1% of this maximum potential $V_{max}$ relative to 100 μm of length of the electrode element, so as to ensure sufficiently rapid displacement of the cathode sheath within the said interval between the position $x=x_{ab}$ and the position $x=x_{bc}$ and sufficiently rapid spreading of the discharge;
- the maximum potential of the surface of the dielectric layer located before the expansion region in the ignition region $Z_a$, lying between the position x=0 and $x=x_{ab}$, is strictly less than the maximum potential of the surface of the dielectric layer located beyond the expansion region in the stabilization region $Z_c$ lying between the position $x=x_{bc}$ and $x=x_{cd}$, so that the stable operating point of the discharge cannot be the ignition region once the discharge has been initiated and so that, once initiated, the discharge necessarily spreads out along the surface of the dielectric layer in the expansion region towards the end of the expansion region;
- the total capacitance of the dielectric layer corresponding to the stabilization region $Z_c$ lying between $x_{bc}$ and $x_{cd}$ is strictly greater than the total capacitance of the dielectric layer corresponding to the ignition region $Z_a$ lying between 0 and $x_{ab}$; and
- the specific longitudinal capacitance of the dielectric layer in the stabilization region $Z_c$ is greater than the specific longitudinal capacitance of the dielectric layer at any point in the expansion region $Z_b$ and in the ignition region $Z_a$; thus, a maximum amount of energy is dissipated in the high-efficiency end-of-discharge region $Z_c$.

To simplify the definition of the invention, the normalized surface potential $V_{norm}$ is defined as the ratio of the surface potential V at position x of the dielectric layer for the electrode element in question to the maximum possible potential along the Ox axis for an electrode element of infinite width, that is to say greater than the width $W_c$ of the cell.

If a normalized potential at the start of the expansion region $(x=x_{ab})$ is chosen to have a value $V_{n-ab}$ and a normalized potential at the end of the expansion region $(x=x_{bc})$ is chosen to have a value $V_{n-bc}$, then preferably: $V_{n-bc}>V_{n-ab}$, $V_{n-ab}>0.9$ and $(V_{n-bc}-V_{n-ab})<0.1$.

By producing a potential distribution on the surface of the dielectric layer such as that described above, a discharge having the following properties is obtained:

- the discharge is initiated between the two facing ends of the electrode elements 4, 4', in the gap 5; these ends correspond to the initiation edges;
- the electrons are strongly attracted by the natural electric field to the anode and initially rapidly spread out the discharge along the anode;
- the positive charges are deposited on that surface portion of the dielectric layer located beneath the cathode sheath, and the cathode sheath rapidly undergoes a movement owing to the effect of the transverse electric field created by the potential difference $\Delta V$, so that the initial discharge current I1 remains low and that part of the electrical energy of the discharge that is dissipated in the first phase of the discharge, before significant expansion, remains low in accordance with the intended aim of the invention; and
- the discharge is extended and then rapidly stabilizes between the two ends $x_{bc}$ of the expansion regions of each electrode element 4, 4' so that, during this second phase of the discharge, the electrical current is high and that part of the electrical energy of the discharge that is dissipated in this second phase of the discharge, and especially the stabilization phase, is high, in accordance with the intended aim of the invention.

To determine the surface potential at the surface of a dielectric layer in a coplanar cell of a plasma display panel, a modelling operation is carried out using the abovementioned SIPDP2D version 3.04 software from Kinema Software, developed in collaboration with the CPAT laboratory based in Toulouse, France and Kinema Research in the United States. This software employs a 2D discharge model under the typical conditions of a plasma display panel.

The input parameters for this model comprise, in particular:

- the composition of the discharge gas: typically 5% Xe and 95% Ne;
- the dimensions of the cell: typically, width $W_c$ between $0.10000\times10^{-1}$ cm and $0.30000\times10^{-1}$ cm; length $L_c$ between $0.20000\times10^{-1}$ cm and $0.60000\times10^{-1}$ cm;
- number of periods along the width and the length of the cell in order to define the profile of the two opposed electrode elements of a cell: 48×48;
- pressure of the discharge gas: typically between 350 and 700 torr;
- temperature of the discharge gas: 300 K; De/Mue (eV)= 1.000;
- secondary electron emission coefficients of the magnesia layer: $0.500000\times10^{-1}$ in the case of Xe and 0.400000 in the case of Ne;
- relative permittivity of the dielectric: typically 10.000;
- conditions at the walls: 1 (1="symmetry", 2="periodic"); this parameter has no influence if an electrode element feature located between two wall media is clearly defined;
- pulse type: 2 (1="Single Pulse", 2="Multi", 3="Breakdown"); end of discharge: 90 μs;
- number of pulses: typically 10;
- end-of-discharge threshold: when the ion density is below $0.100000\times10^{8}$ $cm^{-3}$; and
- definition of a sequence:
  - i1–i2 i3 "times": 3 4 2
  - voltage pulse waveform: "Step" (1) or "Linear" (2) or "sinusoidal" (3): 1
  - Vel1 Vel2 Vel3 Vel4 Vel5 (durations in μs) 0.00 200.00 0.00 0.00 0.00 20.00

The software therefore has a mesh of 48 periods×48 periods on which, in a cross section of the cell in order to study the influence of the electrode width, at any point, the shape of the dielectric layer covering the electrodes and its local dielectric constant are entered. Bars of variable width are then positioned on this mesh, these bars representing, on the one hand, the coplanar electrode element on the front, coplanar electrode plate of the display panel and, on the other hand, the address electrode on the other, rear electrode plate. For the modelling trials, a coplanar electrode of variable width centred on the Ox axis was chosen.

After the structure data has been entered, the potential of each of the electrodes is entered. Of course, by setting the front face at 1 volt and the address electrode on the rear face at 0 volts, a normalized potential distribution between 0 and 1 on the surface of the dielectric layer in the cell can be obtained directly. When the software model is run, no discharge is effected because it is desired to obtain the potential distribution of the dielectric layer. The various trials also show that, before or after a discharge, the model gives exactly the same potential distribution on the surface of the dielectric layer since the distribution of memory charges perfectly follows the lines of potential. By applying 0 and 1 V, of course no discharge will ever be produced, but the desired surface potential distribution will be obtained.

Even if there are no simulated discharges, it is therefore necessary to run the software a few periods and then to stop it and recover, from the tables of results delivered by the software, the potential values at the surface of the dielectric layer. When the electrodes have a central recess (see later for the case of subdivision of electrode elements), it is necessary to adopt as result the maximum potential on the dielectric layer located on each lateral electrode element part which, owing to the axis of symmetry, is identical on each lateral part.

To determine the surface potential at the surface of a dielectric layer above the electrode elements of one and the same discharge region of a coplanar electrode plate, it is also possible to use methods in which the potential at the surface of the dielectric layer is measured directly, which methods are known per se and will not be described here in detail; measurements are then made above one of the electrode elements by applying a constant potential difference between the two electrodes supplying the said discharge region, having a suitable sign so that the electrode element in question acts as cathode.

In a first general embodiment of the invention, the potential distribution according to the invention at the surface of the dielectric layer may be obtained by modifying the thickness or the relative permittivity of the dielectric layer covering the electrode elements of constant width. The ratio of the surface potential V(x) at the position x to the potential applied to the electrode V may be approximated by the equation:

$$V(x)/V=1-[E_{1(x)}/P_{1(x)}]/[E_{1(x)}/P_{1(x)}+H_{(x)}+E_{2(x)}/P_{2(x)}]$$

in which E1($x$) is the thickness expressed in microns and P1($x$) is the relative permittivity of the dielectric layer above each electrode element 4, 4' at the position x along the discharge expansion axis Ox; E2(x) is the thickness expressed in microns and P2(x) is the relative permittivity of the dielectric layer above the address electrode X, or above the electrode plate 2 in the absence of an address electrode, at the position x along the discharge expansion axis Ox.

According to this first general embodiment of the invention, the ratio $1-[E_{1(x)}/P_{1(x)}]/[E_{1(x)}/P_{1(x)}+H_{(x)}+E_{2(x)}/P_{2(x)}]$ increases, continuously or discontinuously, with x for $0<x<x_{bc}$; within said interval, the change in this ratio comprises no point of negative increase; in the case of a discontinuous increase, increasing in jumps, the change in this ratio preferably comprises at least two plateaus within this interval; in the case of continuous increase, this ratio preferably increases linearly with x (according to a law of the ax+b type).

Preferably, in the case of the first embodiment of the invention, one or more of the following conditions are also combined:

- the ratio $1-[E_{1(x)}/P_{1(x)}]/[E_{1(x)}/P_{1(x)}+H_{(x)}+E_{2(x)}/P_{2(x)}]$ for $x_{ab}<x<x_{bc}$ is between 0.9 and 1;
- the electrode element has a constant width $W_e(x)$ and a suitable length so that the total length of the discharge region at the end of the discharge $L_{max}$, which extends between the opposed ends of the electrode elements on either side of the inter-electrode space 5, is less than or equal to $L_c$–200 μm;
- the ratio $1-[E_{1(x)}/P_{1(x)}]/[E_{1(x)}/P_{1(x)}+H_{(x)}+E_{2(x)}/P_{2(x)}]$ for $0<x<x_{ab}$ is strictly less than the said ratio for $x_{bc}<x<x_{cd}$; and
- the ratio $1-[E_{1(x)}/P_{1(x)}]/[E_{1(x)}/P_{1(x)}+H_{(x)}+E_{2(x)}/P_{2(x)}]$ for $x_{ab}<x<x_{bc}$ is less than the said ratio for $x_{bc}<x<x_{cd}$ and never less than the said ratio reduced by 5% in the $0<x<x_{ab}$ range.

Figure 8:
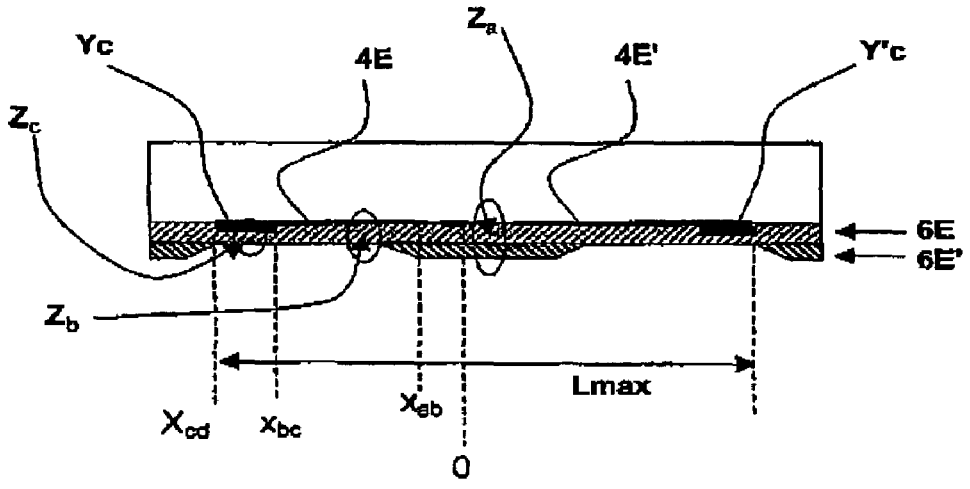
FIG. 8 illustrates a first general embodiment of the invention based on a structure in which the thickness of the dielectric layer varies.

FIG. 8 shows a first example of the invention according to this first general embodiment. It is difficult for the electrostatic properties of the dielectric layer 6 of the electrode plate 1 or of the dielectric layer 7 of the electrode plate 2 to be varied continuously. FIG. 8 shows the longitudinal section through a cell according to the invention, the surface potential distribution of which, at the centre of the cell along the Ox axis, given as curve C in FIG. 7, approaches the ideal theoretical curve. This cell, provided with two identical electrode elements 4E, 4E' has the following characteristics:

- each electrode element 4E, 4E' has a constant width, as in FIG. 1A of the prior art, and a length such that the distance $L_{max}$ separating their opposed respective ends is less than $L_c$−200 μm;
- the thickness of this electrode element 4E, 4E', measured along the discharge expansion axis Ox, decreases between x=0 and $x=x_{cd}$ in three successive plateaus, each plateau corresponding to one of the following intervals: $[0;x_{ab}]$, $[x_{ab};x_{bc}]$, $[x_{bc};x_{cd}]$
- in the stabilization region $Z_c$, each electrode element has, for $x_{bc}<x<x_{cd}$, a thickness of more than 5 times the thickness of the electrode element in the rest of the discharge region—this overthickness region generally corresponds to the supply bus for the electrode elements;
- a first uniform dielectric layer 6E of relative permittivity P1 covers the entire discharge region. Thus, compared with the expansion region $Z_b$, the thickness of this layer 6E is less in the stabilization region at the point where the electrode element is thicker; preferably, the thickness of the dielectric layer is designed so that the dielectric thickness in the stabilization region is less than half the dielectric thickness in the expansion region $Z_b$; and
- a second dielectric layer 6E' of relative permittivity P1', identical to or less than that of the first layer 6E, partly covers the discharge region outside the overthickness of the conducting element for $0<x<x_{ab}$ in such a way that the total thickness of the dielectric layers 6E, 6E' in the ignition region $Z_a$ and outside the expansion region $Z_b$ is between 1.5 and 2 times the thickness of the dielectric layer 6E.

A second general embodiment of the invention consists in varying the width $W_e(x)$ of the electrode element in the discharge expansion region $Z_b$ so as to increase the surface potential of the dielectric layer according to the basic law specific to the invention defined above. To simplify matters, a dielectric layer of uniform thickness and uniform composition in the expansion region is then adopted.

Figure 9:
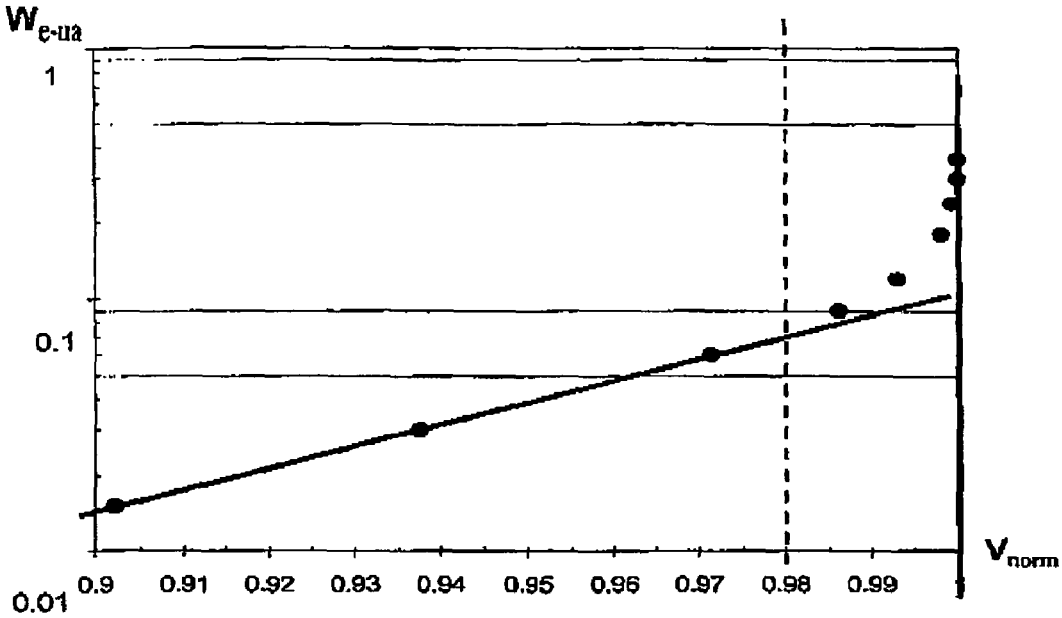
FIG. 9 shows the variation in the normalized surface potential of the dielectric layer as a function of the width, in arbitrary units, of the electrode element in a cell of a plasma display panel.

FIG. 9 shows graphically the general law governing the dependence of the electrode element width $W_{e\text{-}au}$ (on a logarithmic scale in arbitrary units "au") on the normalized potential $V_{norm}$ obtained on the surface of the dielectric layer covering this electrode element before a discharge, $V_{norm}$ having been defined above.

As the above figure illustrates, this variation is split into two parts:

- for the range where $V_{norm}$ lies between 0 and 0.98, the equation allowing $W_e$ to be determined for a desired normalized surface potential $V_{norm}$ is of the type: $W_e=b.\exp(aV_{norm})$
- for the range where $V_{norm}$ lies between 0.98 and 1, the equation between the electrode width and the surface potential of the dielectric layer diverges in such a way that $V_{norm}=1$ can be obtained only for an electrode of infinite width $W_e$.

Of preferential interest is that part of this curve lying between 0 and 0.98, and especially that part of this curve lying between $V_{norm}=0.9$ and $V_{norm}=0.98$, which corresponds, as indicated above, to the preferential surface potential region of the invention. In this part of the curve, the equation between $W_e(x)$ and $V_{norm}(x)$ is then expressed as follows:

$$W_e(x)=W_{e\text{-}ab}\exp\{a[V_{norm}(x)-V_{n\text{-}ab}]\} \quad (1)$$

where $W_{e\text{-}ab}=b.\exp[aV_{n\text{-}ab}]$ represents the width of the electrode element at $x=x_{ab}$ at the start of the expansion region, making it possible to obtain, at this point and before the start of a discharge, the surface potential $V_{n\text{-}ab}$ of the dielectric layer and where $W_{e\text{-}bc}=W_{e\text{-}ab}\exp[a(V_{n\text{-}bc}-V_{n\text{-}ab})]$ represents the width of the electrode element at $x=x_{bc}$ at the end of the expansion region, making it possible to obtain, at this point and before the start of a discharge, the surface potential $V_{n\text{-}bc}$ of the dielectric layer.

Equation (1) above is used to define an ideal width profile $W_{e\text{-}id}(x)$ of the expansion region $Z_b$ of an electrode element as a function of the potential distribution that it is desired to obtain, according to the invention, at the surface of the dielectric layer between the value $V_{n\text{-}ab}$ at the start of the expansion region and the value $V_{n\text{-}bc}$ at the end of the expansion region. According to the invention, this distribution corresponds to a potential that increases continuously or discontinuously between these two values, in such a way that the potential gradient or electric field is positive or zero whatever x between $x_{ab}$ and $x_{bc}$.

The parameter "a" in equation (1) depends mainly on the specific surface capacitance of the dielectric layer 6 of the electrode plate 1. Let E1(x) be the thickness expressed in microns and P1(x) be the relative permittivity of the dielectric layer above the electrode element 4 in question. It has been found experimentally that the parameter "a" varies as the square root of the ratio P1/E1 according to the equation $a=29\sqrt{(P1/E1)}$ so that the higher the specific surface capacitance of the dielectric layer the larger the coefficient "a", that is to say the more the width $W_{e\text{-}id}(x)$ of the electrode element rapidly increases with x.

At the entry of the expansion region, $W_{e\text{-}ab}$ depends directly on the choice of $V_{n\text{-}ab}$. For $V_{n\text{-}ab}=0.9$, it is preferred to choose $W_{e\text{-}ab}$ as a function of E1/P1 according to the equation $W_{e\text{-}ab}(V_{n\text{-}ab}=0.9)=4.6\sqrt{E1}\cdot[\sqrt{(P1/E1)}-0.85]$ (the symbol √ means "square root"). For any other value of $V_{n\text{-}ab}$ lying between 0.9 and 0.98, the corresponding value of $W_{e\text{-}ab}$ can easily be found using the following formula:

$$W_{e\text{-}ab}=W_{e\text{-}ab}(V_{n\text{-}ab}=0.9)\exp[a(V_{n\text{-}ab}-0.9)].$$

In the particular case of the invention in which the surface potential increases linearly between the value $V_{n\text{-}ab}$ and $V_{n\text{-}bc}$, that is to say in which V(x) is an affine function, then $V(x)=(x-x_{ab})(V_{n\text{-}bc}-V_{n\text{-}ab})/(x_{bc}-x_{ab})+V_{n\text{-}ab}$.

The ideal width $W_{e\text{-}id\text{-}0}(x)$ of the electrode element as a function of x can then be defined easily according to the following equation:

$$W_{e\text{-}id\text{-}0}(x)=W_{e\text{-}ab}\exp\{29\sqrt{(P1/E1)}(x-x_{ab})(V_{n\text{-}bc}-V_{n\text{-}ab})/(x_{bc}-x_{ab})\} \quad (2)$$

This equation (2) defines the preferred ideal profile of the invention $W_{e\text{-}id\text{-}0}$, which makes it possible to achieve a linear surface potential distribution in the expansion region.

The distribution shown as curve A in FIG. 7 of the surface potential of the dielectric layer, along the discharge expansion axis Ox, is obtained using the abovementioned modelling software. It is found that the surface potential does indeed increase linearly in the expansion region $Z_a$ between $x=x_{ab}$ and $x=x_{bc}$.

It is possible to define, with respect to this preferential ideal profile $W_{e\text{-}id\text{-}0}$, a lower limit profile $W_{e\text{-}id\text{-}low}$ and an upper limit profile $W_{e\text{-}id\text{-}up}$ using the equations: $W_{e\text{-}id\text{-}low}=$ $0.85W_{e\text{-}id\text{-}0}$ and $W_{e\text{-}id\text{-}up}=1.15W_{e\text{-}id\text{-}0}$, i.e. a difference of −15% and +15% with respect to the preferential ideal width profile respectively.

Within the context of the second general embodiment of the invention, it has been found that any electrode element profile that lies between this lower limit profile $W_{e\text{-}id\text{-}low}$ and this upper limit profile $W_{e\text{-}id\text{-}up}$ makes it possible to achieve a potential distribution that increases continuously or discontinuously between the start and the end of the expansion region $Z_a$, according to the essential general feature of the invention.

It is considered that in the invention the conventional embodiments of dielectric layers limit the P1/E1 ratio so that, in general, 0.2<P1/E1<0.8 and SO that it is preferable, to limit the amount of energy dissipated at the start of the discharges, to choose a width $W_{e\text{-}ab}$ of the conducting element to be less than or equal to 50 μm at the start ($x_{ab}$) of the expansion region $Z_b$ and a width $W_{e\text{-}bc}$ at the end $x_{bc}$ of the expansion region that is strictly greater than this value. However, to avoid having to use excessively high operating voltages (the implementation of which is expensive), a slight loss of energy at the start of the discharges is accepted, and a width $W_{e\text{-}ab}$ of the conducting element is chosen to be slightly greater than this value.

Of course, the manufacturing technologies used to produce the conducting electrode elements have precision limits. The precision in producing the electrodes does not affect the application of the invention, in so far as the electrode width $W_e(x)$ in the expansion region $Z_b$ along the Ox axis varies by no more than ±15% relative to the values defined in the invention.

We now describe the ideal profile of the electrode width along the Ox axis in the direction of expansion of the discharge into the discharge expansion region $Z_b$.

As regards the definition of an ideal profile of the electrode element in the stabilization region, in order to dissipate, as was seen, the maximum amount of energy in the discharge when the latter is at its optimum expansion point, that is to say at the moment when the discharge leaves the expansion region $Z_b$ and enters the stabilization region $Z_c$, it is necessary that the specific longitudinal capacitance of the dielectric layer in the region $Z_c$ be greater than the specific longitudinal capacitance of the dielectric layer at any other point in the discharge region. If $W_s$ is the width of the electrode element in the stabilization region, it is preferable to choose $W_s$ as high as possible, and therefore relatively close to $W_c$ (width of the cell) and it is preferable to choose $W_{e\text{-}bc}$ to be less than or-equal to $W_s$.

FIGS. 10A, 10B, 10C and 10D show examples of the shapes of electrode elements according to this second general embodiment of the invention, in a top view (along the Oz axis in FIG. 6) of a half-cell of a plasma display screen.

Figures 10A, 10B, 10C, 10D:
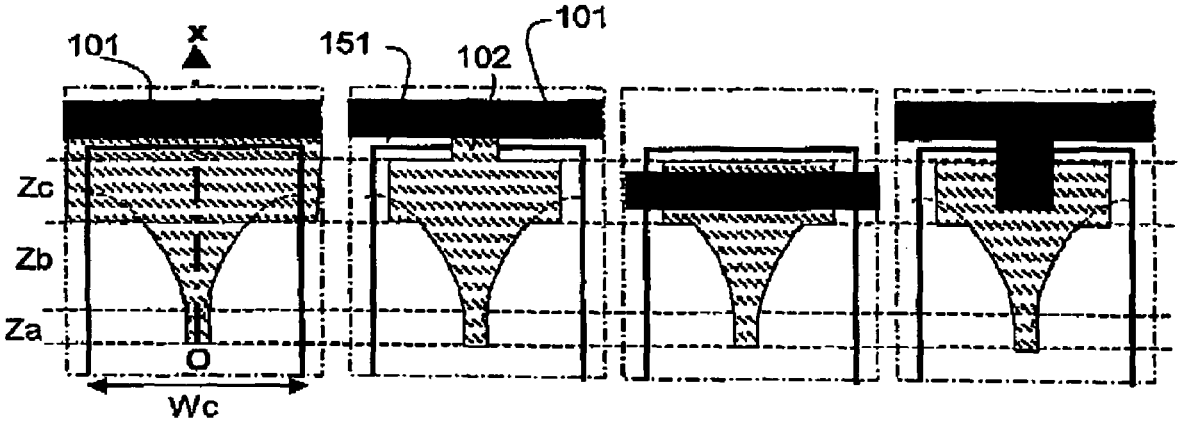

FIG. 10A shows an element of solid shape (hatched region), the profiles of which, beneath the expansion region $Z_b$, meet the specific conditions of this second embodiment of the invention. Preferably, the region of the electrode element hatched in the figure is made of a transparent conducting material. In contrast, the region 101 of the electrode element, shown black in the figure, which corresponds to the conducting bus $Y_c$, $Y'_c$ of the electrode Y, Y', is made of a conducting material, which is generally opaque and has a thickness of greater than that of the hatched region, so that the thickness of the dielectric layer 6 is less in the hatched region. The conducting bus $Y_c$ is preferably positioned outside the discharge region so as not to obscure the visible light emitted by the phosphor layer covering the internal walls of the discharge cell.

It has been found that the cell walls play an important role in the behaviour and the effectiveness of the production of ultraviolet radiation in the discharge, especially in those regions of the electrode element that are located near these walls, in the regions where this element has a width $W_e$ close to the width $W_c$ of the cell. Near the walls, there therefore exists, in each cell, a region of influence in which a substantial increase in the losses of charged or excited particles of the plasma is observed, which causes energy losses, a reduction in the luminous efficiency and a degradation of the phosphors generally deposited on these walls. Under the conventional conditions of operating plasma display screens, this region of influence of the walls typically extends as far as a distance from the walls of between 30 and 50 μm, in particular depending on the composition and the pressure of the discharge gas. Preferably, in the discharge stabilization region $Z_c$, the energy losses resulting from this wall effect are limited by preferably choosing an electrode element width $W_s$ of less than $W_c-(2\times 30\ \mu m)=W_c-60\ \mu m$, but close to this value.

The electrode elements are connected, at the rear of the ignition and expansion regions, to the bus $Y_b$ for the coplanar electrodes Y, Y'. Two options may exist:

- either the bus is integrated into the stabilization region, in which case the aforementioned drawbacks of the wall effect resulting from too high a width of the stabilization region are encountered—this case is illustrated in FIG. 10C described below;
- or the rear bus is set back from the stabilization region, in which case the problem of how to connect the electrode elements to the bus arises. The bus is then preferably positioned on one wall of the cell and then connection elements are used for connecting the electrode elements to the bus, which has a width very much less than that of the stabilization region—this case is illustrated in FIGS. 10B and 10D described below.

The example of FIG. 10B is similar to that of FIG. 10A already described, but, in the discharge stabilization region, the electrode element here has a width less than the width $W_c$ of the cell and is separated from the conducting bus 101 by an insulating thickness 151 of the horizontal wall 15 of the cell, except in an electrical contact region 102 so as not to allow the discharge to penetrate into the wall-effect region of low luminous efficiency. The width of the electrical contact region 102 is generally between 50 μm and 150 μm so as not to increase the contact resistance between the conducting bus $Y_c$ and the discharge stabilization region $Z_c$. The luminous efficiency and the lifetime of the phosphors are therefore further improved by using the structure of FIG. 10B.

By thus reducing the electrode area in the discharge stabilization region, the total capacitance of the dielectric layer in the said region is also partly reduced so that the luminance of the discharge can be reduced.

The example of FIG. 10C repeats the general structure of FIG. 10B, but the conducting bus this time is integrated into the discharge stabilization region and moved further away from the wall-effect region so that the smaller thickness of the dielectric layer covering the conducting bus increases the specific surface capacitance along the conducting bus and in this case increases the capacitance of the discharge stabilization region. Thus the discharge time and the discharge luminance are increased. The example of FIG. 10D is a variant of the example of FIG. 10C, making it possible to reduce the opacity of the conducting bus in the region of visible light emission of the phosphor.

FIGS. 11A to 11D illustrate other examples of the second general embodiment of the invention.

The method of alignment used for assembling the electrode plate 1 with the electrode plate 2 does not always make it possible to align features that are not mutually parallel or perpendicular. It may therefore be preferable not to use an electrode whose profile is curved, as described above. The intended object of the invention can be achieved by increasing the surface potential of the dielectric layer discontinuously, in jumps, using successive conducting element portions of increasing width.

FIG. 11A illustrates an example identical to that of FIG. 10C, except that, beneath the expansion region, the electrode element is formed from a central conductor of narrow width $W_r$ that electrically connects a succession of conducting segments of constant width $W_{e1}$, $W_{e2}$, $W_{e3}$ extending transversely to the central conductor in the order of increasing width in mean positions of these segments labelled x1, x2, x3 along the Ox axis. According to the invention, a check is made to ensure that the widths $W_{e1}$, $W_{e2}$, $W_{e3}$, relative to the positions x1, x2, x3 along the Ox axis, do indeed lie between the lower limit profile $W_{e\text{-}id\text{-}low}$ and the upper limit profile $W_{e\text{-}id\text{-}up}$ described above, which differ by −15% and +15% from the ideal linear profile $W_{e\text{-}id\text{-}0}$ defined above in the case of the second general embodiment of the invention. To check this compliance with the definition of the invention, the outline drawn by the broken lines connecting the ends of each conducting segment is taken into account. The spacing $(x_2-x_1)$, $(x_3-x_2)$ between the successive segments preferably decreases along the Ox direction. The number of conducting segments is generally between 3 and 5 inclusive.

It is possible that the process of manufacturing the conducting elements does not allow sufficiently fine segments to be produced, especially in that part of the expansion region closest to the discharge initiation region. It is therefore possible to use one and the same segment of narrow width $W_{e1}$ on a first part of the expansion region $Z_b$ lying between $x_{ab}$ and $x_{b1}$, provided that the length $x_{b1}-x_{ab}$ of that part of the expansion region corresponding to this first segment is less than half the length of the expansion region $x_{bc}-x_{ab}$.

FIG. 11B illustrates an example identical to that of FIG. 11A except that the segments extend here in the same direction as the Ox axis. As in FIG. 11A, their ends define, shown by the dotted lines, a profile complying, to within 15%, with the ideal linear electrode element profile $W_{e\text{-}id\text{-}0}$.

FIG. 11C illustrates an example identical to that of FIG. 10C except that, beneath the expansion region, the electrode element comprises a straight first region of width equal to $W_{e\text{-}ab}$ or to the minimum width permitted by the manufacturing process, and preferably less than 50 μm, and a trapezoidal second region, the smaller base of which is equal to the width of the straight region. The dimensions of the first and second regions are chosen so that the profile of the electrode element is entirely inscribed between the lower limit profile $W_{e\text{-}id\text{-}low}$ and the upper limit profile $W_{e\text{-}id\text{-}up}$ described above, which depart by −15% and +15% respectively from the ideal linear profile $W_{e\text{-}id\text{-}0}$ defined above in the case of the second general embodiment of the invention. According to this variant, the electrode element makes it possible to obtain an effect substantially identical to that of an ideal profile, while advantageously eliminating, however, certain manufacturing constraints. It is preferred to use a straight first region of length less than or equal to 100 μm.

FIG. 11D illustrates a variant of FIG. 11A in which the distance between the electrode segments is zero. The profile of the electrode element then takes the form of a staircase along the Ox axis in which the discharge spreads into the expansion region $Z_b$.

Optimum coplanar-electrode element geometries will now be defined not in the expansion regions, as described above, but in the ignition regions $Z_a$, in order to improve the efficiency during the ignition phases. These geometries are applicable to any type of electrode element, especially to electrode elements according to the second general embodiment of the invention.

The main conditions for defining optimum geometries are the following: minimization of the ignition voltage $V_a$; limitation of the electrical current $I_a$ during the ignition phase; and creation, on the surface of the dielectric in the ignition region, of a potential that is the same as and not greater than the potential at the start of the expansion phase. Curves B1 and C in FIG. 5 show that this latter condition is not fulfilled because there exists a range of x values close to the ignition edge at which this potential exhibits a maximum.

As regards ignition, the well-known Paschen laws make it possible to define the electrical voltage $V_a$ to be applied between the electrodes of any one sustain pair in order to initiate an electron avalanche in the discharge gas filling the discharge regions between the electrode plates of a plasma display panel and thus to generate a plasma discharge. These laws establish the relationships between this voltage and, in particular, the nature and the pressure of the discharge gas and the gap separating the discharge edges of the two electrodes.

According to these laws, only the environment close to the inter-electrode gap, that is to say the length of the facing electrode edges, has a significant impact on the value of this ignition voltage. Thus, in the T-shaped electrode elements of the prior art already described, it is the transverse bar of the T that corresponds to this close environment and constitutes the discharge ignition region $Z_a$. Referring to FIG. 3A, the ignition region of the electrode element is labelled 31, and differs from the expansion region $Z_b$ of this same element, labelled 32.

In practice, an electrode element whose ignition edge is very narrow, as described above in the examples of the second general embodiment of the invention, for example an electrode element provided only with an expansion region, and whose width, at the ignition edge, is about $W_{e\text{-}ab}$, would modify the uniformity of the electric field and the avalanche gain of the discharge, consequently increasing the operating voltages and extending the delay of the discharge for a given voltage, with consequences on the cost of the power electronics and the speed of address of the plasma display screen.

FIG. 13 shows schematically the ignition regions of two electrode elements of one and the same discharge cell. The width of the ignition front is $W_a$ and the "length" of the ignition region, measured along the Ox axis defined above, is equal to $L_a$ and corresponds to the point where the expansion region (not shown) begins and where the width $W_{e\text{-}ab}$ of the expansion region is a minimum.

FIG. 12 shows the variation in the normalized ignition voltage $V_a$ (solid curve) as a function of the width $W_a$ of the ignition front. When the width $W_a$ decreases, the increase in the ignition potential (solid curve) results from two effects:

- the potential on the surface of the dielectric layer decreases as a function of the electrode width, as shown previously, thereby causing the ignition potential to increase by a simple electrostatic effect (bold dotted curve);
- the avalanche gain depends on the number of primary charges present in the region where the ignition is possible, depending on the Paschen conditions. The wider this region, the larger the number of primary charges. A wide ignition region therefore makes it possible to increase the avalanche gain and reduce the ignition potential (fine dotted curve).

Thus, the greater the width $W_a$ of the ignition region, the lower the ignition potential. There exists a minimum width $W_{a-min}$ above which the ignition voltage $V_a$ is not modified, or only slightly, by the width $W_a$ of the ignition front. This width $W_{a-min}$ corresponds to the critical width above which the walls cause not insignificant losses on primary particles created in the space lying between $W_{a-min}$ and $W_c$.

To improve the ignition conditions, it is necessary to reduce the overall capacitance of the dielectric layer in the ignition region so as to reduce the electrical current $I_a$ of the discharge when the cathode sheath of the discharge lies in the ignition region. If the width $W_a$ of the ignition region of the electrode element has to be relatively high, in order to maintain a low ignition voltage, it is therefore preferable for the ignition area to be low enough not to generate too high an ignition current $I_a$. Any increase in the width of the ignition region above $W_{a-min}$ introduces few additional primary particles and results in little or no increase, by electrostatic effect, of the surface potential. Typically, the wall-effect region, lying between $W_{a-min}$ and $W_c$, extends to at most 50 μm from each side wall. It will therefore be preferable to choose an ignition front width $W_a$ greater than or equal to $W_c$−100 microns in order to obtain the lowest ignition potential. Preferably, in the case of cells with a width of greater than 400 μm, $W_a$ does not exceed 300 μm. Preferably, the width of the ignition region will be close to $W_c$−100 microns so as to limit the area and therefore the capacitance of the dielectric layer in the ignition region. To maintain a low capacitance in the ignition region means, as will be explained below, that the other dimension $L_a$ of the ignition region is relatively small.

Only the width $W_a$ of the facing electrode element edges has an influence on the uniformity of the electric field and the number of primary particles causing the avalanche effect. The length $L_a$ of the ignition front changes only the surface potential of the dielectric layer along the ignition region. The variation in the surface potential along this length $L_a$ is similar to the variation given for the electrode width $W_e$ in the expansion region. To maintain a surface potential of the dielectric layer in the ignition region identical to the surface potential at the start of the expansion region, according to one of the above-mentioned conditions, it will be preferable to choose the length $L_a$ of the electrode element to be equal to $W_{e-ab}$. To reduce the ignition voltage $V_a$, it is possible to increase the length $L_a$ of the electrode element in the ignition region beyond $W_{e-ab}$. By experiment, it may be shown that a length of greater than 80 μm no longer substantially reduces the surface potential, but does greatly increase the discharge current $I_a$ in the ignition region, which is prejudicial to luminous efficiency. When the length $L_a$ of the electrode element in the ignition region lies between $W_{e-ab}$ and 80 μm, the distribution of the surface potential of the dielectric along the discharge expansion axis Ox then takes the form of curve B in FIG. 7 (broken curve) which advantageously has, in the ignition region, a smaller maximum than that of curves B1 and C in FIG. 5 for comparable intervals of x values.

It is also possible to choose $W_a > W_{a-min}$ by preferably adopting the following arrangements. It was seen that $W_{a-min}$ corresponds to the width above which the walls cause a substantial reduction in the surface potential of the dielectric layer and not insignificant losses of primary particles created in the space lying between $W_{a-min}$ and $W_c$. In the ignition region $Z_a$, it is therefore possible to distinguish a central region $Z_{a-c}$, for which, at any point, $y \leqq W_{a-min}/2$, and two lateral regions $Z_{a-p1}$, $Z_{a-p2}$ on either side of the central region for which, at any point, $y > W_{a-min}/2$. In the lateral regions $Z_{a-p1}$, $Z_{a-p2}$, it is therefore preferable for the inter-electrode gap to be strictly less than the value that it has in the central region $Z_{a-c}$. Such a profile of the ignition region is described in FIG. 14. Advantageously, this type of profile makes it possible to achieve an even smaller electrode element area in the ignition region and therefore to obtain a low capacitance of the dielectric layer more easily in this region.

The reduction in the gap separating the two electrode elements in the lateral regions $Z_{a-p1}$, $Z_{a-p2}$ close to the walls makes it possible to increase the electric field in this region and to compensate for the reduction in primary particles resorting from the wall effect, by locally adapting the Paschen conditions. The ignition potential is thus reduced for a constant ignition area, or the ignition region area is reduced for a constant ignition potential.

The examples of ignition regions shown in FIGS. 13, 14 may be combined with any other expansion region $Z_b$ and the stabilization region $Z_c$ that are described in the examples of FIGS. 10 and 11, as FIGS. 15A and 15B show, which repeat the general structure of FIG. 10C but with the addition of the ignition regions of respective FIGS. 13 and 14.

A preferred configuration of electrode elements applicable in particular to the second general embodiment of the invention will now be described.

When, as described above, the expansion of the discharge takes place at the centre of the cell along its central longitudinal axis Ox, the discharge benefits from optimum electric field conditions. This is because it is found that the potential distribution at the surface of the dielectric, measured this time along the Oy axis but always before the discharges, has a maximum at the centre of the cell, and therefore at y=0. This potential progressively decreases towards the cell wall, that is to say towards the barrier ribs (increasing |y|). This is because the capacitor formed by these walls between the two electrode plates of the display panel slightly but progressively decreases the surface potential on the dielectric layer along the Oy axis so that the discharge remains centred on the central axis Ox of the cell, at the surface of the dielectric layer covering the coplanar electrode elements of the electrode plate 1, and so that the discharge, that is to say the source of ultraviolet photons, lies at a maximum distance from each phosphor-covered wall (barrier ribs 15, 16 generally supported by the electrode plate 2).

To improve the distribution of ultraviolet photon production and to make the energy dissipation uniform in the cell by reducing the instantaneous current density, it is preferred to subdivide the expansion region into two expansion paths rather than a single one, as in the U-shaped electrodes described with reference to documents EP 0 782 167 and EP 0 802 556. The expansion region of the electrode element according to the invention is then subdivided into two lateral regions $Z_{b-p1}$, $Z_{b-p2}$ that are symmetrical with respect to the Ox axis. The electrode element according to the invention is then subdivided into two lateral conducting elements and the sum $W_{e-p1}(x)+W_{e-p2}(x)$ of the width of each lateral element fulfils the conditions specific to the second general embodiment of the invention defined above, so as to lie between the lower limit profile $W_{e-id-low}$ and the upper limit profile $W_{e-id-up}$ described above, which depart by −15% and +15% respectively from the ideal linear profile $W_{e-id-0}$ defined above. FIG. 16 shows an electrode element according to this preferred embodiment of the invention, in which the two lateral conducting elements give rise to two expansion regions $Z_{b-p1}$ and $Z_{b-p2}$ placed symmetrically with respect to the longitudinal axis of symmetry Ox of the cell.

Preferably, most of each lateral expansion region of the lateral conducting element is more than 30 μm from the side wall of the cell, in order to avoid the deleterious wall effects described above.

The examples of FIGS. 18A, 18B, 18C and 18D repeat the general electrode element scheme shown in FIG. 10C, except that the electrode element here is subdivided into two lateral conducting elements that are symmetrical with respect to the central axis Ox of the cell, both in the expansion region $Z_b$ and in the ignition region $Z_a$. The total width $W_e$ of the lateral conducting elements satisfies, in the expansion region $Z_b$, the general law defined above with reference to the second general embodiment of the invention. Thus, the discharge spreads out along two parallel general directions both in the ignition region $Z_a$ and in the expansion region $Z_b$.

Figures 18A, 18B, 18C, 18D:
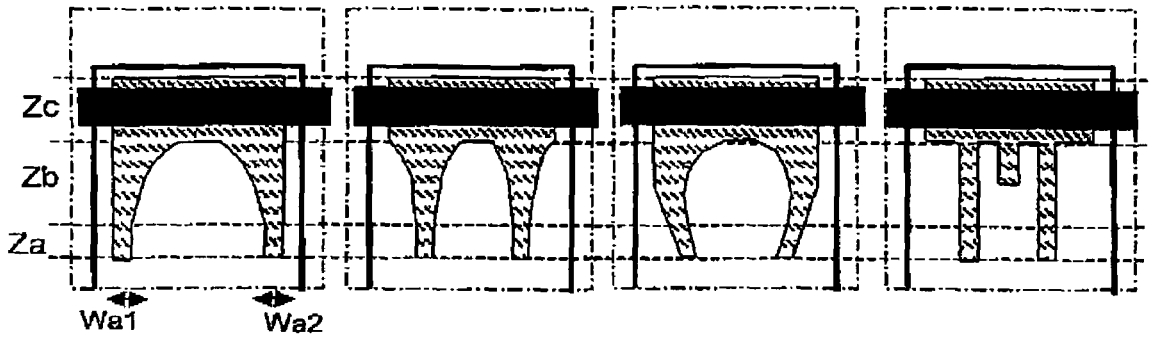

In the example of FIG. 18A, the two lateral conducting elements in the expansion region $Z_b$ each have a lateral edge close to the wall that is parallel to said expansion region and are in this case very far from the central axis Ox of the cell, so as advantageously to reduce the electrostatic effect that they have on each other. Each ignition region of a conducting element has an electrode width $W_{a1}$ and $W_{a2}$ of less than $W_{e\text{-}ab}$.

However, when the two axisymmetric lateral conducting elements are thus very far apart, it is found that the potential distribution at the surface of the dielectric, measured this time along the Oy axis, in the lateral ignition regions $Z_{a\text{-}p1}$, $Z_{a\text{-}p2}$ and before the discharges, has a minimum at the centre y=0 of the cell. The presence of a minimum at the centre of the cell and the transverse central potential barrier that results therefrom disadvantageously limits the excitation region of the discharge. FIG. 17 illustrates this point, by giving the normalized surface potential $V_{0\text{-}norm}$ of the dielectric layer at the centre y=0 of the cell as a function of the distance y1=y2 in μm between the centre of the cell and one or other axisymmetric lateral conducting element edge turned towards this centre, for typical operating conditions for plasma display screen cells. It is found that the surface potential $V_{0\text{-}norm}$ is affected by less than 5% for a distance from the centre y1=y2 of less than about 100 microns and is stable for a distance at the centre of less than 50 microns. Preferably, to maintain a sufficiently high surface potential of the dielectric layer from the longitudinal axis of the cell, a value of between 100 and 200 microns will be chosen for the distance 2y1=2y2 between the edges of the two axisymmetric lateral conducting elements. The example of FIG. 18*b* illustrates this preferred embodiment. This example is similar to that of FIG. 18A, except that the distance between the edges of the two lateral conducting elements is between 100 and 200 μm.

When the two axisymmetric lateral conducting elements are thus brought closer together, the discharge ignition properties are substantially improved. However, in the expansion regions, the electrostatic effect of one lateral conducting element on the other increases and disturbs the variation of the surface potential on the dielectric layer above each lateral conducting element to the point of departure from the general objective pursued by the invention of having an increasing potential, even if the total width $W_e$ of the conducting elements does comply, in the expansion region $Z_b$, with the general law defined above with reference to the second general embodiment of the invention.

It may therefore be seen that it is advantageous not to be too far from the lateral ignition regions $Z_{a\text{-}p1}$, $Z_{a\text{-}p2}$ but sufficiently far away from the lateral expansion regions $Z_{b\text{-}p1}$, $Z_{b\text{-}p2}$ of each axisymmetric lateral conducting element.

The best compromise consists in using, according to a variant of the invention, electrode elements that are subdivided, in the ignition region and most of the expansion region, into two axisymmetric lateral conducting elements in which:

in the lateral ignition regions $Z_{a\text{-}p1}$, $Z_{a\text{-}p2}$, the distance between the facing edges of these regions remains quite small and between 100 and 200 μm in order to limit the reduction in surface potential at the centre of the cell, measured transversely to the Ox axis; and in the lateral expansion regions $Z_{b\text{-}p1}$, $Z_{b\text{-}p2}$, the distance between the facing edges of these regions is greater in order to obtain a surface potential distribution in accordance with the invention, measured transversely to the Ox axis, and to limit the mutual electrostatic effect of these lateral expansion regions.

Let $d_{a\text{-}p}$ be the distance, measured on the Oy axis at the position x=0, between the two facing edges of the first lateral ignition region $Z_{a\text{-}p1}$ and of the second lateral ignition region $Z_{a\text{-}p2}$ and let $d_{e\text{-}p}(x)$ be the distance, measured parallel to the Oy axis, at any x position lying between $x_{ab}$ and $x_{bc}$, between the facing edges of a portion of the first lateral expansion region $Z_{b\text{-}p1}$ positioned at x and of a portion of the second lateral expansion region $Z_{b\text{-}p2}$, also positioned at x.

Preferably, lateral conducting elements will be used for which:

$100\ \mu m \leqq d_{a\text{-}p} \leqq 200\ \mu m$;

there exists a value $x=x_{b2}$ lying between $x_{ab}$ and $x_{bc}$ such that, for any value of x lying between $x_{ab}$ and $x_2$, $d_{e\text{-}p}(x)>d_{a\text{-}p}$.

FIG. 18C illustrates an example of an electrode element subdivided into two lateral conducting elements having these characteristics. Each lateral conducting element is curved at the start towards the walls in such a way that the distance between the two lateral conducting elements is small at the start, within a range lying between 100 and 200 microns, and then increases regularly with x until each lateral conducting element approaches a cell wall at the point that the disadvantageous wall effect starts to be manifested. To avoid this wall effect, the distance that separates the closest lateral edge of each lateral conducting element from a wall remains, at any point in the expansion region, greater than or equal to 30 μm.

Considering, for each lateral conducting element, the trace of the mid-points between its lateral edges, each lateral conducting element may be represented by a mid-line. According to the above characteristics, these two mid-lines move apart up to $x=x_{b2}$ and then come closer together for $x>x_{b2}$.

In order not to impede the displacement of the cathode sheath in the expansion region, it is preferable that, for each lateral conducting element, and in the region where $x_{ab}<x<x_{b2}$, the tangent at x to the mid-line of this element makes an angle of less than 60°, preferably between 30° and 45°, with the Ox axis.

Figures 18E, 18F, 18G:
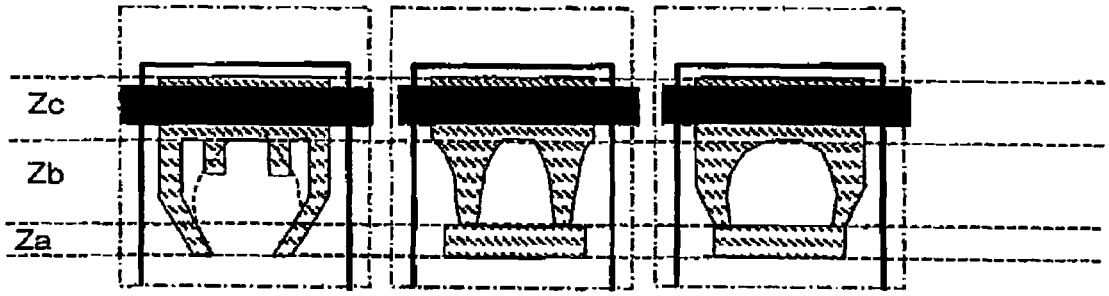

FIGS. 18D and 18E show examples identical to those of FIGS. 18B and 18C respectively, except that, beneath the expansion region, the electrode element is discontinuous and divided into a succession of conducting elements, as described previously with reference to FIG. 11B. As previously, the profile defined by the ends of each segment is such that, in the expansion region, the cumulative width of the electrode element is everywhere inscribed between the lower limit profile $W_{e\text{-}id\text{-}low}$ and the upper limit profile $W_{e\text{-}id\text{-}up}$ described above, which depart by −15% and +15% respectively from the ideal linear profile $W_{e\text{-}id\text{-}0}$ defined above in the case of the second general embodiment of the invention.

Of course, it is advantageous to apply the ignition region or stabilization region shapes described above to these electrode elements in conjunction with the expansion region shapes of FIGS. 18A to 18E, as the examples in FIGS. 18F and 18G show.

In a third general embodiment of the invention, in order to obtain a continuous or discontinuous increase in the surface potential in the expansion region along the Ox axis, the mutual electrostatic effect of two axisymmetric lateral conducting elements is used.

This third general embodiment of the invention therefore relates to electrode elements that are each subdivided, at least in the expansion region, into two axisymmetric lateral conducting elements that have, this time, a constant width but a mutual separation $d_{e-p}(x)$ that decreases continuously or discontinuously with x for any x lying between $x_{ab}$ and $x_{bc}$ so as to obtain, according to the invention, a continuous or discontinuous increase in the surface potential of the dielectric layer along the Ox axis. A dielectric layer of uniform thickness and uniform composition is then maintained in the expansion region.

Figure 19:
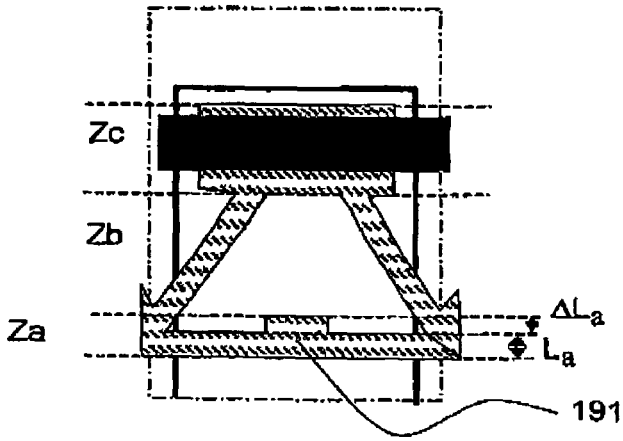
FIG. 19 illustrates a variant of a third general embodiment of the invention based on a structure in which the electrode element is subdivided into two lateral conducting elements that have a constant width.

FIG. 19 gives an example of a structure according to this third embodiment in which the variation in the surface potential of the dielectric layer covering the electrode portions of the expansion region varies with the mean separation of the two lateral conducting elements. Specifically, the electrostatic effect of one electrode portion on the other is sufficiently strong here to allow a variation in the normalized surface potential of between 0.9 and 1, while still maintaining lateral conducting element widths $W_{e-p1}(x)$ and $W_{e-p2}(x)$ that are constant for x varying between $x_{ab}$ and $x_{bc}$. To benefit from this advantageous effect and obtain, according to the invention, a continuous or discontinuous increase in the surface potential of the dielectric layer along the Ox axis, and in the case in which these lateral conducting elements are straight, as shown in the figure, it is necessary that:

$d_{e-p}(x_{ab}) \leqq 350$ μm; and in the region where $x_{ab}<x<x_{bc}$, the tangent at x to the mid-line of each lateral conducting element makes an angle of between 20° and 40° with the Ox axis.

Outside these conditions, the variation in surface potential of the dielectric covering each electrode portion would saturate at a distance $d_{e-p}(x_{ab})$ of greater than 350 μm between the two lateral electrode elements, where the rate of increase of the potential as a function of the position x would be less than the preferential 1% limit level for an x variation of 100 μm, which would be insufficient to obtain rapid spreading of the discharge in the expansion region. Of course, in the region where $x_{ab}<x<x_{bc}$, $W_{e-p1}(x)=W_{e-p2}(x)$=constant.

In the example of FIG. 19, which relates to the specific cases in which 200 μm$<d_{e-p}(x_{ab}) \leqq 350$ μm, so as to limit or even eliminate the reduction in the surface potential of the dielectric layer before the discharges at the centre y=0 of the cell between the two expansion paths (see the explanations below), the ignition region $Z_a$ advantageously includes an elongate central region having a greater length $L_a+\Delta L_a$ than on its two lateral parts, which are each connected to an expansion region $Z_{b-p1}$, $Z_{b-p2}$. This elongate part $\Delta L_a$ forms a projection 191 that advantageously reduces the operating voltages. This is because, even though this projection 191 increases the area of the ignition region $Z_a$ at the centre of the cell and therefore increases the capacitance of the ignition region, the quantity of charge that will be deposited therein will serve only to reduce the operating voltages, as the discharge at this point y=0 cannot extend along the Ox axis of the cell, since the expansion regions of this electrode element are offset laterally with respect to this axis, and the increase in the memory charge at the centre will have no unfavourable impact on the energy of the cathode sheath, unlike the above-mentioned T shape of the prior art, where the formation of the sheath follows on immediately after charge deposition. This central elongation of the electrode element in the ignition region $Z_a$ and at the point where the lateral expansion regions $Z_{b-p1}$ and $Z_{b-p2}$ separate therefore acts as a discharge initiator that involves no additional dissipation of energy for the expansion. For this purpose, it is preferable that the elongation $\Delta L_a$ be chosen such that $\Delta L_a+L_a<80$ μm and that the width $W_{a-i}$ of the projection 191, measured along the Oy axis, is such that $W_{e-ab}<W_{a-i}<80$ μm.

Preferably, for this third embodiment of the invention, one or more of the following conditions are combined:

$W_{e-ab} \leqq W_{e-ab}(P1/E1=0.13)$;

$W_{e-bc} \leqq W_c$ and preferably $W_{e-bc} \leqq Wc - 60$ μm in order to limit the charge losses on the walls.

According to a fourth general embodiment of the invention, each conducting element of the coplanar electrodes comprises, apart from a transverse bar in the ignition region and a transverse bar in the stabilization region that are connected via axisymmetric lateral conducting elements of constant width, as in the prior art, at least one additional transverse bar positioned in the expansion region. Furthermore, the dimensions and the positions of the transverse bars satisfy other conditions, explained below.

Figure 20A:
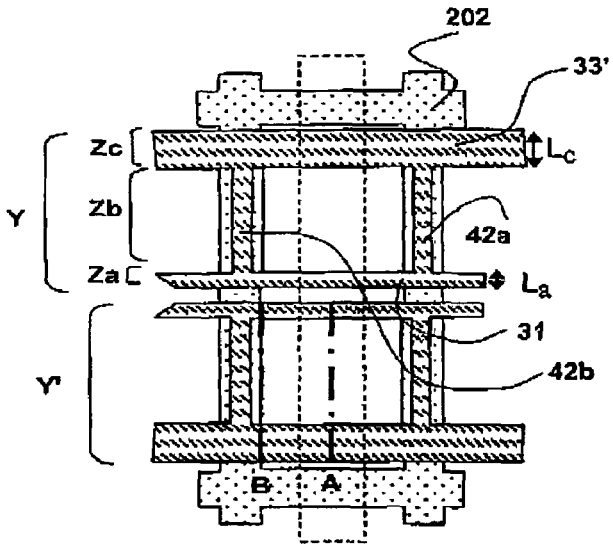
PRIOR ART Fig.20A
FIG. 20A shows a cell structure of the prior art having two transverse bars.

FIG. 20A shows a structure of the type comprising coplanar electrode elements rather similar to that of FIG. 4A, already described with reference to FIG. 9 of document EP 0 802 556 (Matsushita). Each conducting element Y is divided into three regions, namely an ignition region $Z_a$, an expansion region $Z_b$ and a stabilization or end-of-discharge region $Z_c$. The ignition region $Z_a$ corresponds here to the transverse bar 31. The stabilization region $Z_c$ corresponds here to a transverse bar 33' which extends here, unlike FIG. 4A, over a greater length $L_s$ than the length $L_a$ of the transverse bar 31 of the ignition region $Z_a$, these lengths corresponding, as previously, to the length of these bars along the longitudinal axis Ox of the cell. These transverse bars 31, 33' are connected, in the expansion region $Z_b$, via axisymmetric lateral conducting elements or lateral legs 42*a*, 42*b*, which are far apart, since they are shifted towards the walls of the cell, each having a constant width $W_{e-p1}$ and $W_{e-p2}$.

Figure 21:
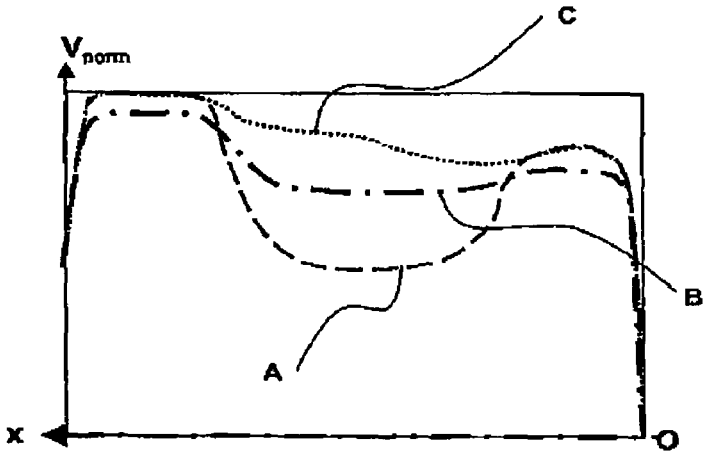
FIG. 21 shows the distribution of the surface potential of the dielectric layer along the electrode elements of the structures of FIGS. 20A and 20B.

FIG. 21 shows the distribution of the surface potential of the dielectric layer in cross section A (curve A) and cross section B (curve B) of the cell of FIG. 20A. This distribution is obtained using the aforementioned SIPDP-2D software.

Since $L_s>L_a$, the capacitance of the dielectric layer located in the end-of-discharge region is greater than the specific capacitance of the dielectric layer located in the discharge ignition region, so as to establish a positive potential difference between the ignition region and the end-of-discharge region. Thus, the aforementioned preferential general condition $V_{n-bc}>V_{n-ab}$ is satisfied.

Just as for the width $W_e$ of a conducting element, the length $L_e$ of a conducting element modifies the potential at the surface of the dielectric layer according to the same laws. In the case of the second embodiment of the invention, the length $L_e$ plays no role as $L_e$ is always greater than $W_e$, so that the variation in the potential at the surface of the dielectric layer is only affected by the width of the conducting element. The surface potential of the dielectric shown by curve A decreases substantially on leaving the ignition region, owing to the absence of an electrode in the expansion region between the two side walls. In this part of the expansion region, the surface potential depends on the potential created by the two perpendicular bars located at the side walls. The further away from the walls, the greater the increase in potential in this region, whereas the potential at the wall edge in the ignition region and in the end-of-discharge region is lower than at the centre of the structure. The preferential discharge path is therefore along the side walls and not at the centre of the cell. In this part of the expansion region located along the border of the wall, the losses are high and the plasma density is low, thereby substantially reducing the number of ultraviolet photons produced, and therefore the luminance. The potential is also relatively constant in this part of the expansion region (curve B) and the creation of the transverse field that allows spreading is not permitted.

To achieve the objective of the invention, which is to have a surface potential that increases continuously or discontinuously in the discharge region and to create the transverse field allowing natural spreading of the discharge, in the cell already described with reference to FIG. 20A, at least one third transverse bar 205 is added according to the fourth general embodiment of the invention. According to the invention, the length $L_b$ of this bar, measured along the longitudinal axis of symmetry Ox of the cell, is such that $L_b \leqq L_a < L_s$. According to the invention, this bar is positioned this time in the expansion region in the following manner: if $d_1$ is the distance between the facing edges of the ignition region $Z_a$ and the expansion region $Z_b$ and if $d_2$ is the distance between the facing edges of the stabilization region $Z_c$ and the expansion region $Z_b$, then $d_2/2 < d_1 < d_2$.

Figure 20B:
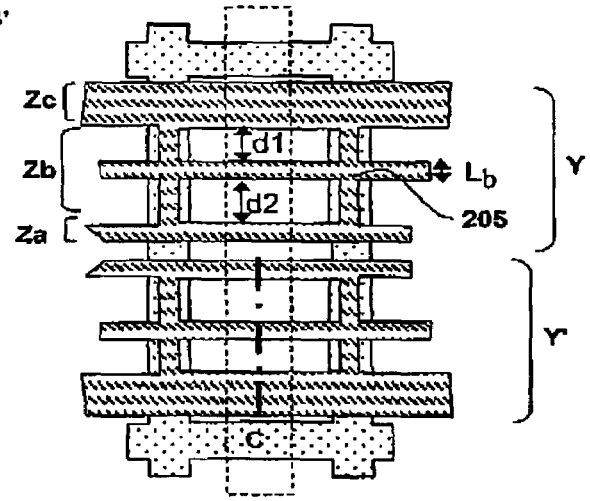
FIG. 20B shows a cell structure having three transverse bars, which illustrates a fourth general embodiment of the invention.

Such a solution is illustrated in FIG. 20B.

By measuring the potential distribution at the surface of the dielectric layer along the Ox axis at the centre y=0 of the cell, curve C of FIG. 21 is obtained. It may be seen that such a distribution complies with the general definition of the invention, whereby this surface potential increases continuously or discontinuously in the discharge region.

Thus, each electrode element comprises at least three transverse bars 31, 205, 33' which extend in a general direction perpendicular to the discharge expansion direction Ox and are connected together by axisymmetric lateral conducting elements that are perpendicular to the transverse bars and positioned at the side walls of the electrode plate 2.

Preferably, $3 \times \max(L_a, L_b) < L_s < 5 \times \max(L_a, L_b)$.

The possible combinations of certain general embodiments that have just been described also form part of the invention provided that, at each electrode element of the coplanar electrode plate, the surface potential of the dielectric in the expansion region increases along the Ox axis when the constant potential applied to this element is negative with respect to the potential applied to the other element of the same discharge region.

The invention is most particularly applicable in cases in which these electrodes Y, Y' of the coplanar electrode plate of the plasma display panel are supplied by voltage pulses having constant voltage plateaus (pulses of rectangular or square waveform) at conventional frequencies generally between 50 and 500 kHz.

The invention claimed is:

1. Coplanar-discharge electrode plate for defining discharge regions in a plasma display panel, which comprises:

at least a first and a second array of coplanar electrodes that are coated with a dielectric layer and the general directions of which are parallel, where each electrode of the first array is adjacent to an electrode of the second array, is paired with it and supply a set of discharge regions;

for each discharge region, at least two electrode elements that have a common longitudinal axis of symmetry Ox, each connected to an electrode of a pair, wherein for each electrode element of each discharge region, the point O on the Ox axis being located on what is called an ignition edge of the electrode element facing the other electrode element of the discharge region and the Ox axis being directed towards what is called an end-of-discharge edge that delimits the electrode element on the opposite side from the discharge edge and is positioned at $x=x_{cd}$ on the Ox axis, the shape of the electrode element and the thickness and composition of the dielectric layer are adapted so that there is an interval $[X_{ab}, X_{bc}]$ of values of x such that $x_{bc}-x_{ab}>0.25x_{cd}$, $x_{ab}<0.33x_{cd}$ and $x_{bc}>0.5x_{cd}$ and such that the surface potential V(x) increases as a function of x in a continuous or discontinuous manner, without a decreasing part, from a value $V_{ab}$ to a higher value $v_{bc}$ within the $[x_{ab}, x_{bc}]$ interval when a constant potential difference is applied between the two electrodes supplying the discharge region, having the appropriate sign so that the electrode element acts as cathode.

2. Coplanar electrode plate according to claim 1, wherein defining the normalized surface potential $V_{norm}(x)$as the ratio of the surface potential V(x) at a level x of the dielectric layer for the electrode element in question to the maximum potential $V_{0\text{-}max}$ that would be obtained along the Ox axis for an electrode element of infinite width, $V_{norm}(x')-V_{norm}(x)>0.001$ whatever x and x' are, chosen between $x_{ab}$ and $x_{bc}$, such that $x'-x=10\ \mu m$.

3. Coplanar electrode plate according to claim 1 wherein defining the normalized surface potential $V_{norm}(x)$ as the ratio of the surface potential V(x) at a level x of the dielectric layer for the electrode element in question to the maximum potential $V_{0\text{-}max}$ that would be obtained along the Ox axis for an electrode element of infinite width, the normalized surface potential $V_{norm}(X)$ increasing from a value of $V_{n\text{-}ab}=V_{ab}/V_{0\text{-}max}$ at the start ($x=x_{ab}$) of the interval to a value of $V_{n\text{-}bc}=V_{bc}/V_{0\text{-}max}$ at the end ($x=x_{bc}$) of the interval, then:

$$V_{n\text{-}bc}>V_{n\text{-}ab},\ V_{n\text{-}ab}>0.9, \text{ and } (V_{n\text{-}bc}-V_{n\text{-}ab})<0.1.$$

4. Coplanar electrode plate according to claim 1, wherein under the same conditions of application of the potential difference between the electrodes, the maximum potential in the surface region of the dielectric layer that covers the electrode element and is bounded by the end-of-discharge edge where $x=x_{cd}$ and the position $x=x_{bc}$ is strictly greater than the maximum potential of the surface region of the dielectric layer that covers the electrode element and is bounded by the ignition edge where x=0 and the position $x=x_{ab}$.

5. Plasma display panel, wherein it is provided with a coplanar electrode plate according to claim 1.

6. Coplanar electrode plate for defining discharge regions in a plasma display panel, which comprises:

at least a first and a second array of coplanar electrodes that are coated with a dielectric layer and the general directions of which are parallel, where each electrode of the first array is adjacent to an electrode of the second array, is paired with it and supply a set of discharge regions;

for each discharge region, at least two electrode elements that have a common longitudinal axis of symmetry Ox, each connected to an electrode of a pair, wherein for each electrode element of each discharge region, the point O on the Ox axis being located on what is called an ignition edge of the electrode element facing the other electrode element of the discharge region and the Ox axis being directed towards what is called an end-of-discharge edge that delimits the electrode element on the opposite side from the discharge edge and is positioned at $x=x_{cd}$ on the Ox axis, defining the specific longitudinal capacitance C(x) of the dielectric layer as the capacitance of a straight elementary strip of this layer, bounded between the electrode element and the surface of the dielectric layer, positioned at x on the Ox axis, having a length dx along this Ox axis and a width corresponding to that of the electrode element delimiting the elementary strip, the shape of the electrode element and the thickness and composition of the dielectric layer are adapted so that there is an interval $[x_{ab},x_{bc}]$ of values of x such that $x_{bc}-x_{ab}>0.25x_{cd}$, $x_{ab}<0.33x_{cd}$ and $x_{bc}>0.5x_{cd}$ wherein the specific longitudinal capacitance C(x) of the dielectric layer increases continuously or discontinuously, without a decreasing part, from a value of $C_{ab}$ at the start ($x=x_{ab}$) of the interval to a value of $C_{bc}$ at the end ($x=x_{bc}$) of the interval.

7. Coplanar electrode plate according to claim 6, wherein the capacitance of the dielectric layer portion that lies between the electrode element and the surface of this layer and is bounded by the end-of-discharge edge where $x=x_{cd}$ and the position $x=x_{bc}$ is strictly greater than the capacitance of the dielectric layer portion that lies between the electrode element and the surface of this layer and is bounded by the ignition edge where x=0 and the position $x=x_{ab}$.

8. Coplanar electrode plate according to claim 7, wherein the specific longitudinal capacitance of the dielectric layer in the region lying between $x=x_{bc}$ and $x=x_{cd}$ is greater than the specific longitudinal capacitance of the dielectric layer at any other position x such that $0<x<x_{bc}$.

9. Plasma display panel, wherein it is provided with a coplanar electrode plate according to claim 6.

10. Plasma display panel comprising a coplanar electrode plate for defining discharge regions, which comprises at least a first and a second array of coplanar electrodes which are coated with a dielectric layer and the general directions of which are parallel, where each electrode of the first array is adjacent to an electrode of the second array, is paired with it and supply a set of discharge regions; and an address electrode plate optionally comprising an array of address electrodes (X) that are coated with a dielectric layer and are oriented and positioned so that each crosses a pair of electrodes of the coplanar electrode plate in one of the discharge regions, these electrode plates defining the discharge regions and being separated by a distance $H_c$ expressed in microns, and for each discharge region, at least two electrode elements that have a common longitudinal axis of symmetry Ox, each connected to an electrode of a pair, wherein for each electrode element of the discharge region, the point O on the Ox axis being located on what is called an ignition edge of the electrode element facing the other electrode element of the discharge region and the Ox axis being directed towards what is called an end-of-discharge edge that delimits the electrode element on the opposite side from the discharge edge and is positioned at $x=x_{cd}$ the Ox axis, the shape of the electrode element, letting E1(x)be the mean thickness expressed in microns and P1(x) be the mean relative permittivity of the dielectric layer above the electrode element at the longitudinal position x and letting E2(x) be the mean thickness expressed in microns and P2(x) be the mean relative permittivity of the dielectric layer above the address electrode (X), or that of the address electrode plate in the absence of the address electrode, the thickness and the permittivity both again being measured at the longitudinal position x located on an axis which lies on the surface of the address electrode plate and is parallel to the Ox axis and lying in a plane normal to the surface of this coplanar electrode plate, the thickness and the composition of the dielectric layer are adapted so that there is an interval $[x_{ab},x_{bc}]$ of values of x such that $x_{bc}-x_{ab}>0.25x_{cd}$, $x_{ab}<0.33x_{cd}$ and $x_{bc}>0.5x_{cd}$ and so that the ratio $R(x)=1-[E_{1(x)}/P_{1(x)}]/[E_{1(x)}/P_{1(x)}+H_c+E_{2(x)}/P_{2(x)}]$ increases continuously or discontinuously, without a decreasing part, from a value of $R_{ab}$ at the start ($x=x_{ab}$) of the interval to a value $R_{bc}$ at the end ($x=x_{bc}$) of the interval.

11. Plasma display panel according to claim 10, wherein the width $W_e(x)$ of the electrode element is constant within the range of x values.

12. Plasma display panel according to claim 11, wherein $R(x')-R(x)>0.001$ whatever x and x' are chosen between $x_{ab}$ and $x_{bc}$, such that $x'-x=10$ μm.

13. Plasma display panel according to claim 12, wherein $R_{bc}>R_{ab}$, $R_{ab}>0.9$, and $(R_{bc}-R_{ab})<0.1$.

14. Plasma display panel according to claim 11, wherein the values of R(x) for any x such that $x_{bc}<x<x_{cd}$ are strictly greater than the values of R(x) for any x such that $0<x<x_{ab}$.

15. Coplanar electrode plate for defining discharge regions in a plasma display panel, which comprises:

at least a first and a second array of coplanar electrodes that are coated with a dielectric layer and the general directions of which are parallel, where each electrode of the first array is adjacent to an electrode of the second array, is paired with it and supply a set of discharge regions;

for each discharge region, at least two electrode elements that have a common longitudinal axis of symmetry Ox, each connected to an electrode of a pair, wherein, for each electrode element of each discharge region, the point O on the Ox axis being located on what is called an ignition edge of the electrode element facing the other electrode element of the discharge region and the Ox axis being directed towards what is called an end-of-discharge edge that delimits the electrode element on the opposite side from the discharge edge and is positioned at $x=x_{cd}$ on the Ox axis, wherein for each electrode element of each discharge region, the dielectric layer has a constant dielectric constant P1 and a constant thickness E1 expressed in microns above said electrode element, at least for any x such that $x_{ab}<x<x_{bc}$, and in which, with the following definitions:

the normalized surface potential $V_{norm}(x)$, defined as the ratio of the surface potential V(x) at a level x of the dielectric layer for the electrode element in question to the maximum potential $V_{0\text{-}max}$ that would be obtained along the Ox axis for an electrode element of infinite width, the normalized surface potential $V_{norm}(x)$ then increasing from a value of $V_{n\text{-}ab}=V_{ab}/V_{0\text{-}max}$ at the start ($x=x_{ab}$) of the interval to a value of $V_{n\text{-}bc}=V_{bc}/V_{0\text{-}max}$ at the end ($x=x_{bc}$) of the interval;

an ideal width profile of this electrode element, defined by the equation:

$$W_{e\text{-}id\text{-}0}(x)=W_{e\text{-}ab}\exp\{29\sqrt{(P1/E1)}(x-x_{ab})\times(V_{n\text{-}bc}-V_{n\text{-}ab})/(x_{bc}-x_{ab})\}$$

where $W_{e\text{-}ab}$ is the total width of the electrode element, measured at $x=x_{ab}$ perpendicular to the Ox axis; and a lower limit profile $W_{e\text{-}id\text{-}low}$ and an upper limit profile $W_{e\text{-}id\text{-}up}$, defined by the equations:

$$W_{e\text{-}id\text{-}low}=0.85W_{e\text{-}id\text{-}0} \text{ and } W_{e\text{-}id\text{-}up}=1.15W_{e\text{-}id\text{-}0},$$

then, for any x between $X_{ab}$ and $X_{bc}$ inclusive, the total width $W_e(x)$ of the electrode element, measured at x perpendicular to the Ox axis, is such that:

$$W_{e\text{-}id\text{-}low}(x)<W_e(x)<W_{e\text{-}id\text{-}up}(x).$$

16. Coplanar electrode plate according to claim 15, wherein the width $W_{e\text{-}ab}$ is less than or equal to 80 μm.

17. Coplanar electrode plate according to claim 16, wherein the width $W_{e\text{-}ab}$ is less than or equal to 50 μm.

18. Coplanar electrode plate according to claim 15, wherein the electrode element is subdivided into two lateral conducting elements that are symmetrical with respect to the Ox axis and are separate at least in the region where x lies within the $[x_{ab},x_{b3}]$ interval where $x_{b3}-x_{ab}>0.7(X_{bc}-X_{ab})$.

19. Coplanar electrode plate according to claim 18, wherein $x_{b3}=x_{bc}$.

20. Coplanar electrode plate according to claim 18 wherein if Oy is an axis transverse to the Ox axis lying along the ignition edge and letting $d_{e-p}(x)$ be the distance, measured parallel to the Oy axis at any position x lying between $X_{ab}$ and $x_{bc}$, between the edges turned towards each other of these two lateral conducting elements, a value $x=x_{b2}$ lying between $X_{ab}$ and $x_{b3}$ exists such that $d_{e-p}(x)>d_{e-p}(x_{ab})$ for any value of x lying between $X_{ab}$ and $X_{b2}$.

21. Coplanar electrode plate according to claim 20, wherein $d_{e-p}(x_{ab})$ lies between 100 μm and 200 μm.

22. Coplanar electrode plate according to claim 21, wherein considering the mean line of each lateral conducting element traced, for a given position x, at mid-distance between the lateral edges of this lateral element, in the region where $x_{ab}<x<x_{b2}$, the tangent at x to the mean line of this element makes an angle of less than 60° with the Ox axis.

23. Coplanar electrode plate according to claim 22, wherein the angle lies between 30 ° and 45°.

24. Coplanar electrode plate according to claim 18, wherein if Oy is an axis transverse to the Ox axis lying along the ignition edge and letting $d_{e-p}(x_{ab})$ be the distance, measured parallel to the Oy axis at a position $x=x_{ab}$ between the edges turned towards each other of the two lateral conducting elements, the electrode element comprises a transverse bar called an ignition bar which connects the lateral conducting elements, one edge of which corresponds to the ignition edge, and the length of which, measured along the Ox axis, is greater by a value $\Delta L_a$ |y| lying between 0 and $y_1$ on either side of the Ox axis than a value $L_a$ of this length for |y| lying between $y_1$ and $d_{e-p}(x_{ab})/2$ on either side of the Ox axis.

25. Plasma display panel, wherein it is provided with a coplanar electrode plate according to claim 15.

26. Plasma display panel according to claim 5, wherein it comprises the said coplanar electrode plate and an address electrode plate defining between the discharge regions and wherein, for each discharge region and for each electrode element, if $W_{e-ab}$ is the width of the electrode element, measured along the Ox axis at the position $x=x_{ab}$ at the start of the $[x_{ab},x_{bc}]$ interval, the electrode element preferably comprises a transverse bar called an ignition bar, one edge of which corresponds to the ignition edge and the length of which, measured along the Ox axis, is such that:

$$W_{e-ab}\leqq L_a<80\ \mu m.$$

27. Plasma display panel according to claim 26, comprising an array of parallel barrier ribs placed between the electrode plates at a distance $W_c$ from one another, perpendicular to the general direction of the coplanar electrodes, characterized in that, if Oy is an axis transverse to the Ox axis lying along the ignition edge and if $W_a$ is the width of the transverse ignition bar, measured along the Oy axis, then:

$$W_c-60\ \mu m<W_a<W_c-100\ \mu m.$$

28. Plasma display panel according to claim 26, comprising an array of parallel barrier ribs placed between the electrode plates at a distance $W_c$ from one another, perpendicular to the general direction of the coplanar electrodes, characterized in that, if Oy is an axis transverse to the Ox axis lying along the ignition edge, if $W_a$ is the width of the transverse ignition bar measured along the Oy axis and if $W_{a-min}$ corresponds to the width beyond which the barrier ribs cause a substantial reduction in the surface potential of the dielectric layer above the said element, the transverse ignition bar comprises:

a central region $Z_{a-c}$ for which, at any point $|y|\leqq W_{a-min}/2$, the distance, along the Ox axis, between the ignition edges of the two electrode elements of the discharge region is constant and equal to $g_c$; and two lateral regions $Z_{a-p1}$, $Z_{a-p2}$ on either side of the central region $Z_{a-c}$, for which, at any point $|y|>W_{a-min}/2$, the distance, along the Ox axis, between the ignition edges of the two electrode elements of the discharge region decreases continuously from the value $g_c$.

29. Plasma display panel according to claim 5, wherein it comprises supply means suitable for generating, between the coplanar electrodes, various pairs of series of voltage pulses called sustain pulses, each with a constant plateau.

30. Plasma display panel according to claim 9, wherein, for each discharge region and for each electrode element, if $W_{e-ab}$ is the width of the electrode element, measured along the Ox axis at the position $x=x_{ab}$ at the start of the $[x_{ab},x_{bc}]$ interval, the electrode element preferably comprises a transverse bar called an ignition bar, one edge of which corresponds to the ignition edge and the length of which, measured along the Ox axis, is such that: $W_{e-ab}\leqq L_a<80\ \mu m$.

31. Plasma display panel according to claim 30, comprising an array of parallel barrier ribs placed between the electrode plates at a distance $W_c$ from one another, perpendicular to the general direction of the coplanar electrodes, wherein, if Oy is an axis transverse to the Ox axis lying along the ignition edge and if $W_a$ is the width of the transverse ignition bar, measured along the Oy axis, then:

$$W_c-60\ \mu m<W_a\leqq W_c-100\ \mu m.$$

32. Plasma display panel according to claim 30, comprising an array of parallel barrier ribs placed between the electrode plates at a distance $W_c$ from one another, perpendicular to the general direction of the coplanar electrodes, wherein, if Oy is an axis transverse to the Ox axis lying along the ignition edge, if $W_a$ is the width of the transverse ignition bar measured along the Oy axis and if $W_{a-min}$ corresponds to the width beyond which the barrier ribs cause a substantial reduction in the surface potential of the dielectric layer above the element, the transverse ignition bar comprises:

a central region $Z_{a-c}$ for which, at any point $|y|\leqq W_{a-min}/2$, the distance, along the Ox axis, between the ignition edges of the two electrode elements of the discharge region is constant and equal to $g_c$; and two lateral regions $Z_{a-p1}$, $Z_{a-p2}$ on either side of the central region $Z_{a-c}$, for which, at any point $|y|>W_{a-min}/2$, the distance, along the Ox axis, between the ignition edges of the two electrode elements of the discharge region decreases continuously from the value $g_c$.

33. Plasma display panel according to claim 9, wherein it comprises supply means suitable for generating, between the coplanar electrodes, various pairs of series of voltage pulses called sustain pulses, each with a constant plateau.

34. Plasma display panel according to claim 10, wherein, for each discharge region and for each electrode element, if $W_{e-ab}$ is the width of the electrode element, measured along the Ox axis at the position $x=x_{ab}$ at the start of the $[x_{ab},z_{bc}]$, interval, the electrode element preferably comprises a transverse bar called an ignition bar, one edge of which corresponds to the ignition edge and the length of which, measured along the Ox axis, is such that: $W_{e-ab}\leqq L_a<80\ \mu m$.

35. Plasma display panel according to claim 34, comprising an array of parallel barrier ribs placed between the electrode plates at a distance $W_c$ from one another, perpendicular to the general direction of the coplanar electrodes, wherein, if Oy is an axis transverse to the Ox axis lying along the ignition edge and if $W_a$ is the width of the transverse ignition bar, measured along the Oy axis, then:

$$W_c-60\ \mu m<W_a\leqq W_c-100\ \mu m.$$

36. Plasma display panel according to claim 34, comprising an array of parallel barrier ribs placed between the electrode plates at a distance $W_c$ from one another, perpendicular to the general direction of the coplanar electrodes, wherein, if Oy is an axis transverse to the Ox axis lying along the ignition edge, if $W_a$ is the width of the transverse ignition bar measured along the Oy axis and if $W_{a\text{-}min}$ corresponds to the width beyond which the barrier ribs cause a substantial reduction in the surface potential of the dielectric layer above the element, the transverse ignition bar comprises:

a central region $Z_{a\text{-}c}$ for which, at any point $|y|\leqq W_{a\text{-}min}/2$, the distance, along the Ox axis, between the ignition edges of the two electrode elements of the discharge region is constant and equal to $g_c$; and two lateral regions $Z_{a\text{-}p1}$, $Z_{a\text{-}p2}$ on either side of the central region $Z_{a\text{-}c}$, for which, at any point $|y|<W_{a\text{-}min}/2$, the distance, along the Ox axis, between the ignition edges of the two electrode elements of the discharge region decreases continuously from the value $g_c$.

37. Plasma display panel according to claim 10, wherein it comprises supply means suitable for generating, between the coplanar electrodes, various pairs of series of voltage pulses called sustain pulses, each with a constant plateau.

38. Plasma display panel according to claim 25, wherein, for each discharge region and for each electrode element, if $W_{e\text{-}ab}$ is the width of the electrode element, measured along the Ox axis at the position $x=x_{ab}$ at the start of the $[x_{ab},x_{bc}]$ interval, the electrode element preferably comprises a transverse bar called an ignition bar, one edge of which corresponds to the ignition edge and the length of which, measured along the Ox axis, is such that; $W_{e\text{-}ab}<L_a<80\ \mu m$.

39. Plasma display panel according to claim 38, comprising an array of parallel barrier ribs placed between the electrode plates at a distance $W_c$ from one another, perpendicular to the general direction of the coplanar electrodes, wherein, if Oy is an axis transverse to the Ox axis lying along the ignition edge and if $W_a$ is the width of the transverse ignition bar, measured along the Oy axis, then:

$$W_c-60\ \mu m<W_a\leqq W_c-100\ \mu m.$$

40. Plasma display panel according to claim 38, comprising an array of parallel barrier ribs placed between the electrode plates at a distance $W_c$ from one another, perpendicular to the general direction of the coplanar electrodes, wherein, if Oy is an axis transverse to the Ox axis lying along the ignition edge, if $W_a$ is the width of the transverse ignition bar measured along the Oy axis and it $W_{a\text{-}mim}$ corresponds to the width beyond which the barrier ribs cause a substantial reduction in the surface potential of the dielectric layer above the element, the transverse ignition bar comprises:

a central region $Z_{a\text{-}c}$ for which, at any point $|y|\leqq W_{a\text{-}min}/2$, the distance, along the Ox axis, between the ignition edges of the two electrode elements of the discharge region is constant and equal to $g_c$; and two lateral regions $Z_{a\text{-}p1}$, $Z_{a\text{-}p2}$ on either side of the central region $Z_{a\text{-}c}$ , for which, at any point $|y|>W_{a\text{-}min}/2$, the distance, along the Ox axis, between the ignition edges of the two electrode elements of the discharge region decreases continuously from the value $g_c$.

41. Plasma display panel according to claim 25, wherein it comprises supply means suitable for generating, between the coplanar electrodes, various pairs of series of voltage pulses called sustain pulses, each with a constant plateau.

* * * * *

UNITED STATES PATENT AND TRADEMARK OFFICE

CERTIFICATE OF CORRECTION

PATENT NO. : 7,586,465 B2
APPLICATION NO. : 10/518567
DATED : September 8, 2009
INVENTOR(S) : Tessier et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 844 days.

Signed and Sealed this

Fourteenth Day of September, 2010

David J. Kappos

David J. Kappos
*Director of the United States Patent and Trademark Office*